US012529362B2

(12) United States Patent
Katsuda et al.

(10) Patent No.: US 12,529,362 B2
(45) Date of Patent: Jan. 20, 2026

(54) POSITIVE DISPLACEMENT MACHINE, COMPRESSOR, COOLING APPARATUS, AND ELECTRONIC EQUIPMENT

(71) Applicant: SEIKO EPSON CORPORATION, Tokyo (JP)

(72) Inventors: Osamu Katsuda, Matsumoto (JP); Kaname Nagatani, Matsumoto (JP); Hidemasa Yamakawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 204 days.

(21) Appl. No.: 18/192,790

(22) Filed: Mar. 30, 2023

(65) Prior Publication Data

US 2023/0323869 A1 Oct. 12, 2023

(30) Foreign Application Priority Data

Mar. 30, 2022 (JP) ..... 2022-055549

(51) Int. Cl.
*F04B 35/04* (2006.01)
*F25B 31/02* (2006.01)

(52) U.S. Cl.
CPC ..... *F04B 35/04* (2013.01); *F25B 31/026* (2013.01)

(58) Field of Classification Search
CPC ..... F04B 35/04; F04B 27/005; F04B 27/02; F04B 27/053; F25B 31/026; F25B 31/023; F25B 2400/074
See application file for complete search history.

(56) References Cited

U.S. PATENT DOCUMENTS

RE30,994 E * 7/1982 Shaw ..... F01C 21/02 417/366
2023/0014696 A1* 1/2023 Manke et al. ..... F04B 35/04

FOREIGN PATENT DOCUMENTS

BR 9605357 A * 7/1998 ..... F04B 35/04
EP 3168473 A 5/2017
EP 3748160 A 12/2020
JP S62-46898 U 3/1987
JP H02-037181 A 2/1990
(Continued)

OTHER PUBLICATIONS

JP 2022028991 A Translation (Year: 2022).*
(Continued)

*Primary Examiner* — Jerry-Daryl Fletcher
*Assistant Examiner* — Dario Antonio Deleon
(74) *Attorney, Agent, or Firm* — Dority & Manning, P.A.

(57) ABSTRACT

A positive displacement machine includes a housing including a tubular guide part in which a pressure chamber is provided, a slide member including a piston disposed in the guide part, the slide member sliding in a first direction, a coupling member coupled to the slide member and extending in a second direction intersecting the first direction, a first rotating member coupled to a first end portion of the coupling member and configured to rotate centering on a first rotation axis extending in the second direction, and a first motor. The first motor includes a first rotor coupled to the first rotating member and configured to rotate centering on the first rotation axis and an adjuster configured to adjust a position of the first rotor with respect to the housing, the position extending along an imaginary plane perpendicular to the first rotation axis.

10 Claims, 7 Drawing Sheets

(56) References Cited

FOREIGN PATENT DOCUMENTS

| | | | | | |
|---|---|---|---|---|---|
| JP | H09-072275 | A | | 3/1997 | |
| JP | 2002-153021 | A | | 5/2002 | |
| JP | 2003-065260 | A | | 3/2003 | |
| JP | 2003-214104 | A | | 7/2003 | |
| JP | 2011017282 | A | * | 1/2011 | ..... F04B 35/04 |
| JP | 2016-017513 | A | | 2/2016 | |
| JP | 2017-008918 | A | | 1/2017 | |
| JP | 2017218932 | A | * | 12/2017 | ..... F04D 29/056 |
| JP | 2019132203 | A | * | 8/2019 | ..... F04B 39/0094 |
| JP | 2022028991 | A | * | 2/2022 | ..... F04D 29/056 |

OTHER PUBLICATIONS

JP 2019132203 A Translation (Year: 2019).*
JP 2017218932 A Translation (Year: 2017).*
BR 9605357 A Translation (Year: 1998).*
JP 2011017282 A Translation (Year: 2011).*

* cited by examiner

POSITIVE DISPLACEMENT MACHINE, COMPRESSOR, COOLING APPARATUS, AND ELECTRONIC EQUIPMENT

The present application is based on, and claims priority from JP Application Serial Number 2022-055549, filed Mar. 30, 2022, the disclosure of which is hereby incorporated by reference herein in its entirety.

BACKGROUND

1. Technical Field

The present disclosure relates to a positive displacement machine, a compressor, a cooling apparatus, and electronic equipment.

2. Related Art

There has been known a positive displacement machine used in a compressor for refrigeration air conditioning, an internal combustion engine for generator driving, and the like (see, for example, JP-A-9-072275 (Patent Literature 1)).

The positive displacement machine described in Patent Literature 1 is a hermetic compressor. The hermetic compressor includes a reciprocating member including two pistons, a cylinder block, two arms, two spherical bushes, two driving shafts including driving arms, and two driving motors. The two pistons are supported by the inner circumferential cylindrical surface of the cylinder block to be capable of implementing reciprocation and a swinging motion around an axis in a reciprocating direction. Each of the two arms is rotatably inserted into an inner circumferential cylindrical surface section of the spherical bush corresponding to the arm. Outer circumferential spherical surface sections of the spherical bushes are supported in positions displaced from rotation axes of the driving shafts by the driving arms of the driving shafts corresponding to the spherical bushes.

In such a hermetic compressor, the two driving arms are rotated in opposite directions each other around the driving shafts by the two driving motors and the two arms coupled to the driving arms via the spherical bushes move in the reciprocating direction, whereby the reciprocating member reciprocates in the cylinder block. Consequently, the pistons swing while reciprocating on the inner circumferential cylindrical surface of the cylinder block, whereby working fluid flowing into a workspace is compressed and thereafter discharged to the outside.

As explained above, in the positive displacement machine described in Patent Literature 1, the two driving shafts including the driving arms are rotated in the opposite directions each other by the two driving motors and the two arms coupled to the driving arms corresponding thereto of the two driving arms move in the reciprocating direction, whereby the reciprocating member reciprocates. Therefore, in order to appropriately drive the positive displacement machine, it is necessary to appropriately combine the driving shafts, the driving arms included in the driving shafts, and the arms. However, backlash due to tolerance sometimes occurs among the components. In such a case, it is difficult to appropriately combine the components.

Therefore, there has been a demand for a configuration of a positive displacement machine that can improve assemblability.

SUMMARY

A positive displacement machine according to a first aspect of the present disclosure includes: a housing including a tubular guide part in which a pressure chamber is provided; a slide member including a piston disposed in the guide part, the slide member sliding in a first direction; a coupling member coupled to the slide member and extending in a second direction intersecting the first direction; a first rotating member coupled to a first end portion of the coupling member and configured to rotate centering on a first rotation axis extending in the second direction; and a first motor. The first motor includes: a first rotor coupled to the first rotating member and configured to rotate centering on the first rotation axis; and an adjuster configured to adjust a position of the first rotor with respect to the housing, the position extending along an imaginary plane perpendicular to the first rotation axis.

A compressor according to a second aspect of the present disclosure includes the positive displacement machine according to the first aspect. The piston is configured to compress gas flowing into the pressure chamber.

A cooling apparatus according to a third aspect of the present disclosure includes: the compressor according to the second aspect configured to compress working fluid in a gas phase; a condenser configured to condense the working fluid in the gas phase compressed by the compressor into the working fluid in a liquid phase; an expander configured to decompress the working fluid in the liquid phase condensed by the condenser and change the working fluid in the liquid phase to the working fluid in which the liquid phase and the gas phase are mixed; and an evaporator coupled to a cooling target to transfer heat, the evaporator being configured to change the working fluid flowing from the expander to the working fluid in the gas phase with the heat transferred from the cooling target and discharge the changed working fluid in the gas phase to the compressor.

Electronic equipment according to a fourth aspect of the present disclosure includes the cooling apparatus according to the third aspect.

DESCRIPTION OF EXEMPLARY EMBODIMENTS

First Embodiment

A first embodiment of the present disclosure is explained below with reference to the drawings.

Configuration of Electronic Equipment

Figure 1:
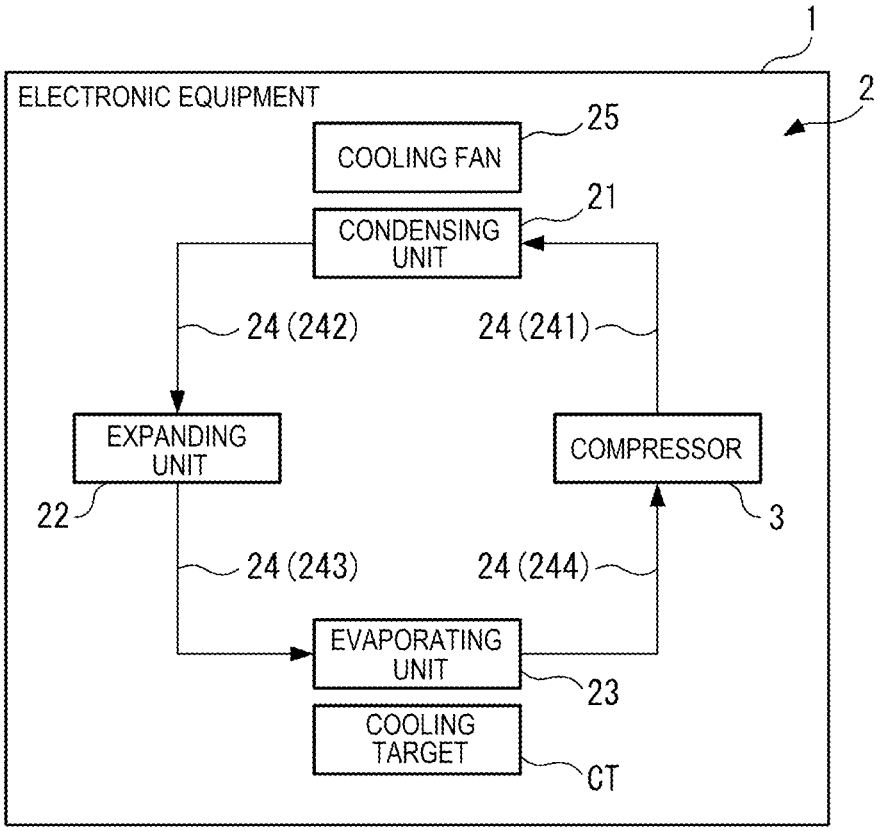
FIG. 1 is a block diagram showing a configuration of electronic equipment in a first embodiment.

FIG. 1 is a block diagram showing a configuration of electronic equipment 1 according to this embodiment.

The electronic equipment 1 according to this embodiment includes a cooling target CT and a cooling apparatus 2 as shown in FIG. 1.

The cooling target CT configures the electronic equipment 1. Examples of the cooling target CT include a control device that controls the electronic equipment 1 and a power supply device that supplies electric power to electronic components of the electronic equipment 1.

Configuration of the Cooling Apparatus

The cooling apparatus 2 cools the cooling target CT. Specifically, the cooling apparatus 2 circulates working fluid, which changes in phase between a liquid phase and a gas phase, and cools the cooling target CT.

The colling device 2 includes a compressor 3, a condenser 21, an expander 22, an evaporator 23, a plurality of pipes 24, and a cooling fan 25.

Schematic Configuration of the Compressor

The compressor 3 compresses the working fluid in the gas phase. That is, the compressor 3 compresses the working fluid in the gas phase flowing in from the evaporator 23 to thereby increase the temperature and the pressure of the working fluid in the gas phase. The working fluid in the gas phase increased in the temperature and the pressure by the compressor 3 flows to the condenser 21.

A configuration of the compressor 3 is explained in detail below.

Configuration of the Condenser

The condenser 21 is coupled to the compressor 3 via the pipe 24. The condenser 21 condenses the working fluid in the gas phase compressed by the compressor 3, that is, the working fluid in the gas phase increased in the temperature and the pressure into the working fluid in the liquid phase. Specifically, the condenser 21 exchanges heat between the compressed working fluid in the gas phase and the cooling gas circulated to the condenser 21 by the cooling fan 25 to thereby condense the working fluid in the gas phase into the working fluid in the liquid phase having high pressure.

Configuration of the Expander

The expander 22 is a decompressor and is coupled to the condenser 21. The expander 22 decompresses the working fluid in the liquid phase condensed by the condenser 21 and changes a state of the working fluid to a state in which the liquid phase and the gas phase are mixed. That is, the expander 22 reduces the temperature of the working fluid. The expander 22 discharges, to the evaporator 23, the working fluid in the state in which the liquid phase and the gas phase are mixed. The expander 22 can be configured by, for example, an expansion valve capable of controlling an evaporation temperature of the working fluid in the liquid phase, specifically, an electronic expansion valve, and can be configured by a capillary tube.

Configuration of the Evaporator

The evaporator 23 is coupled to the cooling target CT to be capable of transferring heat. The evaporator 23 evaporates, with the heat transferred from the cooling target CT, the working fluid in the liquid phase flowing from the expander 22, changes the working fluid in the liquid phase to the working fluid in the gas phase, and discharges the changed working fluid in the gas phase to the compressor 3. Consequently, the heat of the cooling target CT is consumed and the cooling target CT is cooled.

Configuration of the Plurality of Pipes

The plurality of pipes 24 annularly couple the compressor 3, the condenser 21, the expander 22, and the evaporator 23. The plurality of pipes 24 are tubular members in which the working fluid can flow.

The plurality of pipes 24 include a first pipe 241, a second pipe 242, a third pipe 243, and a fourth pipe 244.

The first pipe 241 couples the compressor 3 and the condenser 21.

The second pipe 242 couples the condenser 21 and the expander 22.

The third pipe 243 couples the expander 22 and the evaporator 23.

The fourth pipe 244 couples the evaporator 23 and the compressor 3.

In this way, the cooling apparatus 2 includes a circulation path of the working fluid that flows through the compressor 3, the first pipe 241, the condenser 21, the second pipe 242, the expander 22, the third pipe 243, the evaporator 23, and the fourth pipe 244 in order and flows into the compressor 3 again. The circulation path cools the cooling target CT.

Detailed Configuration of the Compressor

Figure 2:
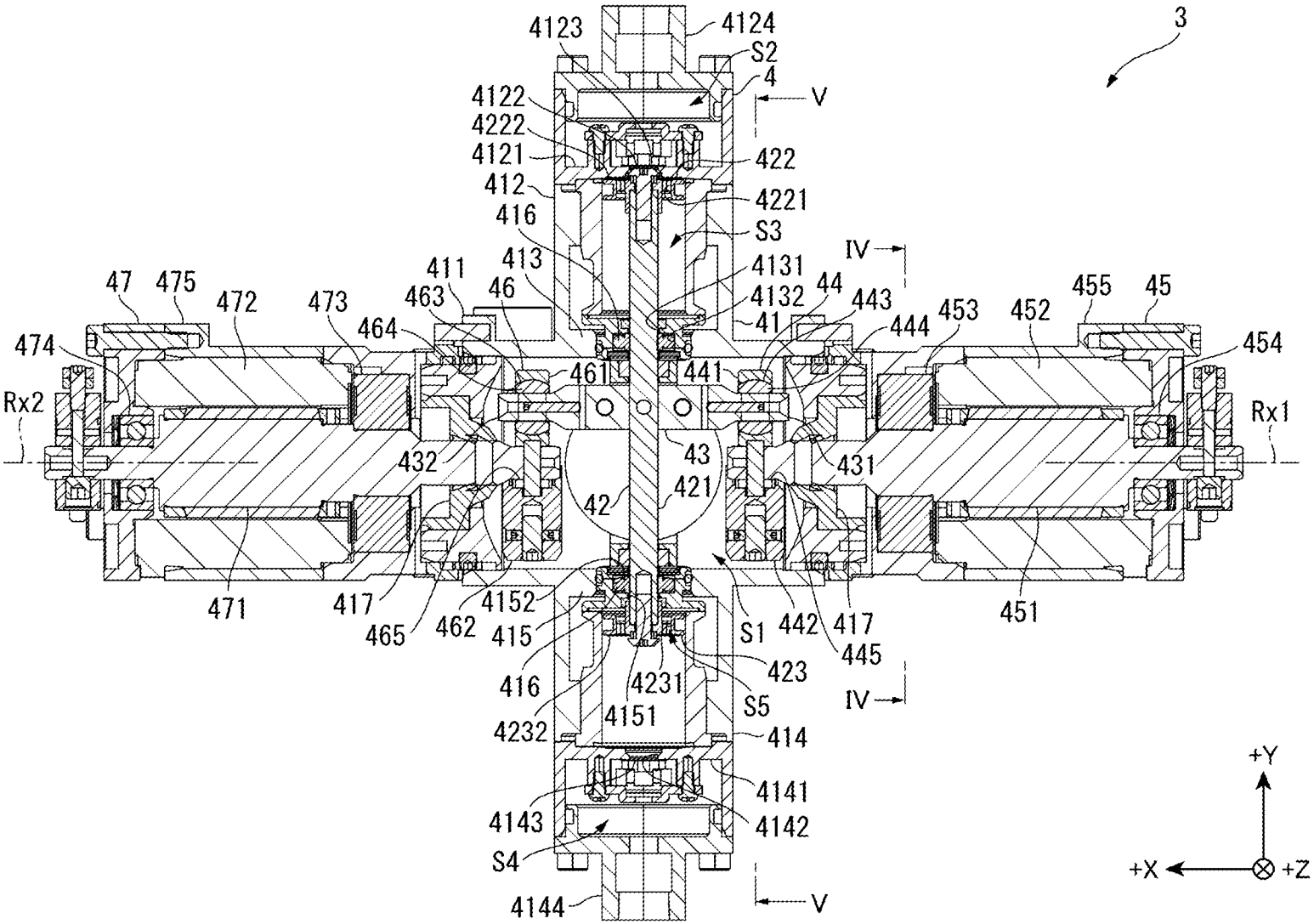
FIG. 2 is a sectional view showing a compressor in the first embodiment.

FIG. 2 is a sectional view showing the compressor 3.

As explained above, the compressor 3 compresses the working fluid in the gas phase flowing in from the evaporator 23 and discharges the working fluid to the condenser 21. Specifically, the compressor 3 is a reciprocating compressor that compresses the working fluid in the gas phase that is gas flowing into a first pressure chamber S2 and a second pressure chamber S4 explained below according to reciprocation of a first piston 422 and a second piston 423 of a slide member 42 explained below. The compressor 3 includes a positive displacement machine 4 as shown in FIG. 2.

Configuration of the Positive Displacement Machine

The positive displacement machine 4 includes a housing 41, the slide member 42, a coupling member 43, a first rotating member 44, a first motor 45, a second rotating member 46, and a second motor 47. Besides, although not shown in FIG. 2, the positive displacement machine 4 includes first fixing members 48 (see FIG. 3) that fix the first motor 45 to the housing 41 and second fixing members (not shown) that fix the second motor 47 to the housing 41.

In the following explanation, three directions orthogonal to one another are represented as a +X direction, a +Y direction, and a +Z direction. The +X direction is a direction extending from the first motor 45 toward the second motor 47. That is, the left direction when viewed in FIG. 2 is the +X direction. A first rotation axis Rx1 of the first motor 45 and a second rotation axis Rx2 of the second motor 47 explained below extend in the +X direction. The +Y direction is a direction extending in a reciprocating direction of the slide member 42 and extending from the second piston 423 toward the first piston 422 included in the side member 42. That is, the upward direction when viewed in FIG. 2 is the +Y direction. The +Y direction is a direction crossing the rotation axes Rx1 and Rx2. A direction facing the paper surface when viewed in in FIG. 2 is the +Z direction.

Further, although not shown, the opposite direction of the +X direction is represented as a −X direction, the opposite direction of the +Y direction is represented as a −Y direction, and the opposite direction of the +Z direction is represented as a −Z direction. That is, the right direction when viewed in FIG. 2 is the −X direction, the downward direction when viewed in FIG. 2 is the −Y direction, and the direction perpendicularly standing from the paper surface when viewed in FIG. 2 is the −Z direction.

In this embodiment, the +X direction or the −X direction is equivalent to the second direction and the +Y direction or the −Y direction is equivalent to the first direction.

Configuration of the Housing

The housing 41 is a housing that houses main components of the positive displacement machine 4 and to which the motors 45 and 47 are attached. The housing 41 configures the exterior of the positive displacement machine 4. The housing 41 includes a housing part 411, a first guide part 412, a first segmenting part 413, a second guide part 414, a second segmenting part 415, two first sealing members 416, and two second sealing members 417. Besides, although not shown in FIG. 2, the housing 41 includes first attachment parts 418 (see FIG. 3) to which the first fixing members 48 are attached and second attachment parts (not shown) to which the second fixing members are attached. The first attachment parts 418 and the second attachment parts are equivalent to the attachment part of the present disclosure.

Configuration of the Housing Part

The housing part 411 is a housing main body in which a mechanism chamber S1 is provided, a part of the slide member 42, the coupling member 43, the first rotating member 44, a part of the first motor 45, the second rotating member 46, and a part of the second motor 47 being housed on the inside of the mechanism chamber S1.

The mechanism chamber S1 includes lubricant on the inside. In other words, the housing 41 includes the lubricant encapsulated in the mechanism chamber S1. In this embodiment, an amount of the lubricant is approximately a half of the capacity of the mechanism chamber S1. However, the amount of the lubricant is not limited to this and can be changed as appropriate.

Configuration of the First Guide Part

The first guide part 412 is formed in a cylindrical shape and projects in the +Y direction from the housing part 411. The first piston 422 is disposed on the inside of the first guide part 412. The first guide part 412 guides the reciprocation of the first piston 422 in the +Y direction.

The first pressure chamber S2 and a first working chamber S3 are provided on the inside of the first guide part 412.

The first pressure chamber S2 is a space in the +Y direction for the first piston 422 in a space on the inside of the first guide part 412. That is, the first pressure chamber S2 is a space provided in the first guide part 412, the capacity of the pressure chamber S2 changing according to the slide of the first piston 422.

The first working chamber S3 is a space in the −Y direction for the first piston 422 in the space on the inside of the first guide part 412. That is, the first working chamber S3 is a space provided between the mechanism chamber S1 and the first pressure chamber S2 on the inside of the first guide part 412 and is divided from the first pressure chamber S2 by the first piston 422. A space between the mechanism chamber S1 and the first working chamber S3 is sealed by the first sealing member 416 in the +Y direction of the two first sealing members 416.

The first guide part 412 includes a first partition wall 4121, a first discharge valve 4123, and a first outflow part 4124.

The first partition wall 4121 segments the first pressure chamber S2 into a first suction chamber, which is a space in the −Y direction, and a first high-pressure chamber, which is a space in the +Y direction. A through-hole 4122 piecing through the first partition wall 4121 in the +Y direction is provided in the first partition wall 4121. The first suction chamber and the first high-pressure chamber communicate via the through-hole 4122. The working fluid in the gas phase is supplied to the first suction chamber from the first working chamber S3 via a channel 4221 of the first piston 422.

The first discharge valve 4123 opens when the pressure in the first suction chamber is higher than the pressure in the first high-pressure chamber.

The first outflow part 4124 is provided in a portion on the first high-pressure chamber side in the first guide part 412. The first outflow part 4124 is coupled to the first pipe 241 (see FIG. 1).

A part of the working fluid flows into a space in the first guide part 412 and is supplied into the first suction chamber via the channel 4221 and a suction valve 4222 of the first piston 422 by the reciprocation of the first piston 422. Thereafter, the working fluid in the gas phase flows into the first high-pressure chamber from the first suction chamber via the first discharge valve 4123 while being compressed by the first piston 422 and flows out to the first pipe 241 from the first outflow part 4124.

Configuration of the First Segmenting Part

The first segmenting part 413 is a segmenting part that is provided in a coupling portion of the housing part 411 and the first guide part 412 and segments the mechanism chamber S1 and the first working chamber S3. The first segmenting part 413 projects in the inner diameter direction from a portion on the first guide part 412 side in the housing part 411. The first segmenting part 413 includes a communication hole 4131 and a disposing part 4132.

The communication hole 4131 pierces through the first segmenting part 413 in the +Y direction. A rod 421 of the slide member 42 is inserted through the communication hole 4131 in the +Y direction. That is, the first working chamber S3 is connected to the mechanism chamber S1 via the communication hole 4131.

The disposing part 4132 is a portion where the first sealing member 416 in the +Y direction is disposed in the first segmenting part 413.

Configuration of the Second Guide Part

The second guide part 414 is formed in a cylindrical shape and projects in the −Y direction from the housing part 411. The second piston 423 is disposed on the inside of the second guide part 414. The second guide part 414 guides reciprocation in the +Y direction of the second piston 423.

A second pressure chamber S4 and a second working chamber S5 are provided on the inside of the second guide part 414.

The second pressure chamber S4 is a space in the −Y direction for the second piston 423 in a space on the inside of the second guide part 414. That is, the second pressure chamber S4 is a space provided in the second guide part 414, the capacity of the space changing according to the slide of the second piston 423.

The second working chamber S5 is a space in the +Y direction for the second piston 423 in the space on the inside of the second guide part 414. That is, the second working chamber S5 is a space provided between the mechanism chamber S1 and the second pressure chamber S4 on the inside of the second guide part 414 and divided from the second pressure chamber S4 by the second piston 423. A space between the mechanism chamber S1 and the second working chamber S5 is sealed by the first sealing member 416 in the −Y direction of the two first sealing members 416.

The second guide part 414 includes a second partition wall 4141, a second discharge valve 4143, and a second outflow part 4144 that are the same as the first partition wall 4121, the first discharge valve 4123, and the first outflow part 4124 of the first guide part 412.

The second partition wall 4141 segments the second pressure chamber S4 into a second suction chamber, which is a space in the +Y direction, and a second high-pressure chamber, which is a space in the −Y direction. A through-hole 4142 piercing through the second partition wall 4141 in the +Y direction is provided in the second partition wall 4141. The second suction chamber and the second high-pressure chamber communicate via the through-hole 4142. The working fluid is supplied to the second suction chamber from the second working chamber S5 via a channel 4231 of the second piston 423.

The second discharge valve 4143 opens when the pressure in the second suction chamber is higher than the pressure in the second high-pressure chamber.

The second outflow part 4144 is provided in a portion on the second high-pressure chamber side in the second guide part 414. The second outflow part 4144 is coupled to the first pipe 241.

Another part of the working fluid flows into a space in the second guide part 414 and is supplied into the second suction chamber via the channel 4231 and a suction valve 4232 of the second piston 423 by reciprocation of the second piston 423. Thereafter, the working fluid in the gas phase flows into the second high-pressure chamber from the second suction chamber via the second discharge valve 4143 while being compressed by the second piston 423 and flows out to the first pipe 241 from the second outflow part 4144.

Configuration of the Second Segmenting Part

The second segmenting part 415 is a segmenting part that is provided in a coupling portion of the housing part 411 and the second guide part 414 and segments the mechanism chamber S1 and the second working chamber S5. The second segmenting part 415 projects in the inner diameter direction from a portion on the second guide part 414 side in the housing part 411. The second segmenting part 415 includes a communication hole 4151 and a disposing part 4152.

The communication hole 4151 pierces through the second segmenting part 415 in the +Y direction. The rod 421 of the slide member 42 is inserted through the communication hole 4151 in the +Y direction. That is, the second working chamber S5 is connected to the mechanism chamber S1 via the communication hole 4151.

The disposing part 4152 is a portion where the first sealing member 416 in the −Y direction is disposed in the second segmenting part 415.

Configuration of the Slide Member

The slide member 42 is coupled to the coupling member 43, slides in the ±Y direction together with the coupling member 43, and changes the capacities of the first pressure chamber S2 and the second pressure chamber S4. The slide member 42 includes the rod 421, the first piston 422, and the second piston 423.

The rod 421 is a shaft member extending in the +Y direction. A center portion of the rod 421 in the +Y direction is disposed in the mechanism chamber S1. The rod 421 is coupled to the coupling member 43.

The first piston 422 is a piston provided at the end portion of the rod 421 in the +Y direction and disposed in the first guide part 412. The first piston 422 has an outer diameter larger than the outer diameter of the rod 421. When the rod 421 reciprocates in the +Y direction, the first piston 422 reciprocates in the +Y direction in the first guide part 412. When sliding in the +Y direction, the first piston 422 reduces the capacity of the first pressure chamber S2. Consequently, the first piston 422 compresses the working fluid in the gas phase flowing into the first pressure chamber S2. The working fluid in the gas phase is an example of the gas.

The second piston 423 is a piston provided at the end portion of the rod 421 in the −Y direction and disposed in the second guide part 414. The second piston 423 has an outer diameter larger than the outer diameter of the rod 421. When the rod 421 reciprocates in the +Y direction, the second piston 423 reciprocates in the +Y direction in the second guide part 414. When sliding in the −Y direction, the second piston 423 reduces the capacity of the second pressure chamber S4. Consequently, the second piston 423 compresses the working fluid in the gas phase flowing into the second pressure chamber S4. As explained above, the working fluid in the gas phase is an example of the gas.

Configuration of the Coupling Member

The coupling member 43 is disposed in the mechanism chamber S1. The coupling member 43 is coupled to the slide member 42, the first rotating member 44, and the second rotating member 46. The coupling member 43 moves in the ±Y direction according to rotation of the rotating members 44 and 46 and moves the slide member 42 in the ±Y direction. In other words, the coupling member 43 converts rotational motions of the rotating members 44 and 46 into linear motions in the ±Y direction of the slide member 42.

The coupling member 43 includes a first end portion 431 in the −X direction and a second end portion 432 in the +X direction.

The first end portion 431 is inserted into a first bearing 444 of the first rotating member 44.

The second end portion 432 is the end portion on the opposite side of the first end portion 431. The second end portion 432 is inserted into a second bearing 464 of the second rotating member 46.

When the first end portion 431 is inserted into the first bearing 444 and the second end portion 432 is inserted into the second bearing 464, the coupling member 43 is disposed in the +X direction.

Configuration of the First Rotating Member

The first rotating member 44 is coupled to a first rotor 451 of the first motor 45 and the first end portion 431 of the coupling member 43. The first rotating member 44 rotates together with the first rotor 451 coaxially with the first rotor 451. That is, the first rotating member 44 is coupled to the first end portion 431, which is one end of the coupling member 43, and rotates centering on the first rotation axis Rx1 extending in the +X direction. In other words, the first rotating member 44 is integrated with the first rotor 451 and rotates centering on the first rotation axis Rx1 together with the first rotor 451.

The first rotating member 44 includes a first crank 441, a semicircular first weight 442, a first disposing part 443, a first bearing 444, and a first fitting part 445.

The first crank 441 is coupled to the first rotor 451 and the first end portion 431. The first weight 442, the first disposing part 443, the first bearing 444, and the first fitting part 445 are provided in the first crank 441.

The first weight 442 is a counter weight for reducing vibration caused by reciprocation of the slide member 42 in the +Y direction and is fixed to the first crank 441. When the slide member 42 slides in the +Y direction most, that is, when the slide member 42 slides to the top dead center, the first weight 442 is disposed in the −Y direction with respect to the first rotation axis Rx1. In other words, when the slide member 42 slides in the −Y direction most, that is, when the slide member 42 slides to the bottom dead center, the first weight 442 is disposed in the +Y direction with respect to the first rotation axis Rx1.

The first disposing part 443 is a hole piercing through the first rotating member 44 in the +X direction. The first bearing 444 is disposed on the inside of the first disposing part 443.

The first bearing 444 is a spherical slide bearing disposed in the first disposing part 443 and is provided to be rotatable along the inner surface of the first disposing part 443. The first end portion 431 is inserted into the inside of the first bearing 444 in the −X direction. That is, the first bearing 444 supports the first end portion 431.

The end portion in the +X direction in the first rotor 451 is inserted into and fit in the first fitting part 445. That is, the first rotating member 44 is integrated with the first rotor 451 in the first fitting part 445. Consequently, the first rotating member 44 rotates centering on the first rotation axis Rx1 integrally with the first rotor 451.

Configuration of the Second Rotating Member

The second rotating member 46 is coupled to a second rotor 471 of the second motor 47 and the second end portion 432 of the coupling member 43 and rotates coaxially with the second rotor 471 together with the second rotor 471. That is, the second rotating member 46 is coupled to the second end portion 432, which is the other end of the coupling member 43, and rotates, centering on the second rotation axis Rx2 extending in the +X direction, in the opposite direction of a rotating direction of the first rotating member 44. In other words, the second rotating member 46 is integrated with the second rotor 471 and rotates centering on the second rotation axis Rx2 together with the second rotor 471.

The second rotating member 46 includes a second crank 461, a semicircular second weight 462, a second disposing part 463, a second bearing 464, and a second fitting part 465.

The second crank 461 is coupled to the second rotor 471 and the second end portion 432. The second weight 462, the second disposing part 463, the second bearing 464, and the second fitting part 465 are provided in the second crank 461.

Like the first weight 442, the second weight 462 is a counter weight for reducing vibration caused by reciprocation of the slide member 42 in the +Y direction and is fixed to the second crank 461. The second weight 462 is disposed in the −Y direction with respect to the second rotation axis Rx2 when the slide member 42 slides to the top dead center and is disposed in the +Y direction with respect to the second rotation axis Rx2 when the slide member 42 slides to the bottom dead center.

The second disposing part 463 is a hole piercing through the second rotating member 46 in the +X direction. The second bearing 464 is provided on the inside of the second disposing part 463.

The second bearing 464 is a spherical slide bearing disposed in the second disposing part 463 and is provided rotatably along the inner surface of the second disposing part 463. The second end portion 432 is inserted into the inside of the second bearing 464 in the +X direction. That is, the second bearing 464 supports the second end portion 432.

The end portion in the −X direction in the second rotor 471 is inserted into and fit in the second fitting part 465. That is, the second rotating member 46 is integrated with the second rotor 471 in the second fitting part 465. Consequently, the second rotating member 46 rotates centering on the second rotation axis Rx2 integrally with the second rotor 471.

Although not shown, when moving in the ±Y direction according to rotation of the rotating members 44 and 46 that rotate in opposite directions each other, the coupling member 43 is turned, centering on an axis extending in the +Y direction, clockwise or counterclockwise when viewed from the +Y direction. Specifically, when the coupling member 43 located at the bottom dead center is moved in the +Y direction according to the rotation of the rotating members 44 and 46, the coupling member 43 is turned in one direction of the clockwise direction and the counterclockwise direction when viewed from the +Y direction until the coupling member 43 reaches the half of a moving range in the +Y direction. When the coupling member 43 located in the top dead center is moved in the −Y direction according to the rotation of the rotating members 44 and 46, the coupling member 43 turns in the other direction of the clockwise direction and the counterclockwise direction when viewed from the +Y direction until the coupling member 43 reaches the half of a moving range in the −Y direction. The coupling member 43 turns in one direction of the clockwise direction and the counterclockwise direction when viewed from the +Y direction until the coupling member 43 reaches the bottom dead center from a position of the half of the moving range in the −Y direction. In this way, when reciprocating in the +Y direction, the coupling member 43 swings, centering on the axis extending in the +Y direction, clockwise or counterclockwise when viewed from the +Y direction.

When the coupling member 43 swings in this way, the first bearing 444 slides in the +X direction with respect to the first end portion 431 and the second bearing 464 slides in the +X direction with respect to the second end portion 432.

Configuration of the First Motor

The first motor 45 is fixed to the housing 41 in a state in which the first motor 45 is coupled to the first rotating member 44. The first motor 45 rotates the first rotating member 44 centering on the first rotation axis Rx1 and moves the coupling member 43 and the slide member 42 in the ±Y direction. The first motor 45 includes the first rotor 451, a first stator 452, a front-end-side bearing 453, a rear end side bearing 454, and a first case 455.

Configurations of the First Rotor and the First Stator

The first rotor 451 extends in the +X direction and is rotated centering on the first rotation axis Rx1 by the first stator 452. The end portion of the first rotor 451 facing the +X direction is inserted into the first fitting part 445 of the first rotating member 44. That is, the first rotor 451 is coupled to the first rotating member 44 and rotates centering on the first rotation axis Rx1. The second sealing member 417 in the −X direction of the two second sealing members 417 is an oil seal that seals a space between the inner wall of the mechanism chamber S1 and the first rotor 451. The second sealing member 417 restricts the lubricant encapsulated in the mechanism chamber S1 from moving to the outside of the mechanism chamber S1.

The first stator 452 is a rotator that rotates the first rotor 451. The first stator 452 is disposed on the outer side of the first rotor 451 when viewed along the first rotation axis Rx1.

Configuration of the Front-End-Side Bearing

The front-end-side bearing 453 is provided in the first case 455 and supports the first rotor 451 rotatably centering on the first rotation axis Rx1.

The front-end-side bearing 453 is equivalent to the rotor-side bearing and is a slide bearing in this embodiment. The front-end-side bearing 453 is provided around the first rotor 451 in the +X direction. In other words, the front-end-side bearing 453 is disposed on the outer side of the first rotor 451 when viewed along the first rotation axis Rx1. The first rotor 451 rotates along the inner surface of the front-end-side bearing 453. That is, clearance in a degree for enabling the first rotor 451 to rotate is provided between the outer circumferential surface of the first rotor 451 and a surface on the opposite side of the first rotor 451 in the front-end-side bearing 453. A portion on the opposite side of the first rotor 451 in such a front-end-side bearing 453 is fixed to the first case 455.

Configuration of the Rear End Side Bearing

The rear end side bearing 454 is provided in the first case 455 and supports the first rotor 451 rotatably centering on the first rotation axis Rx1 in conjunction with the front-end-side bearing 453.

The rear end side bearing 454 is a roller bearing. An inner ring of the rear end side bearing 454 is coupled to the first rotor 451 inserted into the inner ring of the rear end side bearing 454. An outer ring of the rear end side bearing 454 is coupled to the inner surface of the first case 455. Consequently, the first rotor 451 is rotatably supported by the first case 455.

Configuration of the First Case

Figure 3:
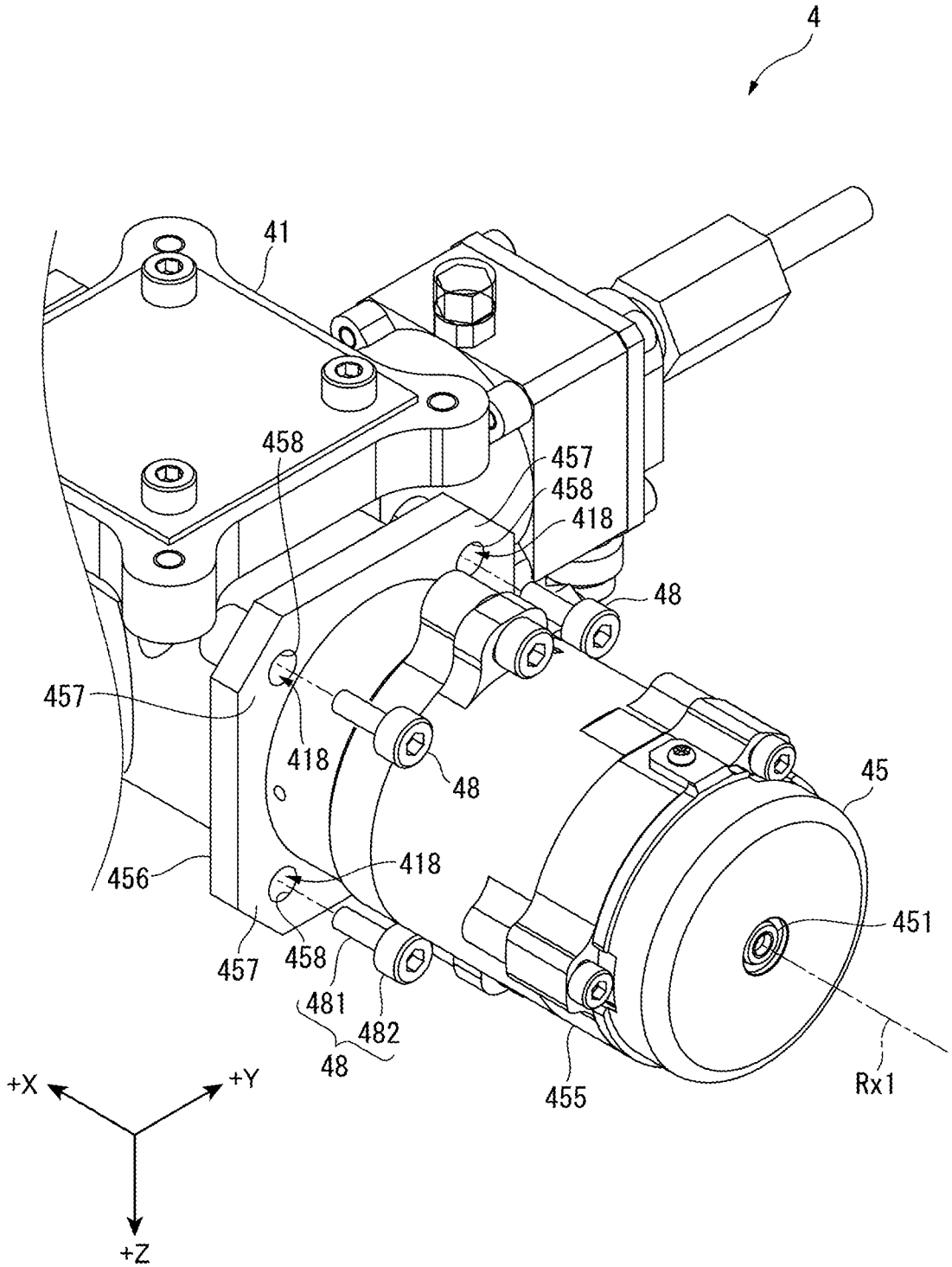
FIG. 3 is a perspective view showing a housing and a first motor in the first embodiment.

FIG. 3 is a perspective view showing the housing 41 and the first motor 45.

As shown in FIG. 2, the first case 455 is a cylindrical member that houses a part of the first rotor 451, the first stator 452, the front-end-side bearing 453, and the rear end side bearing 454. Specifically, the first case 455 houses the first stator 452, the front-end-side bearing 453, and the rear end side bearing 454 and supports the first rotor 451 rotatably centering on the first rotation axis Rx1.

As shown in FIG. 3, the first case 455 is fixed to the housing 41 by the first fixing members 48. The first case 455 includes a flange 456 and adjusters 457.

The flange 456 is provided at the end portion of the first case 455 facing the +X direction. The flange 456 is a portion expanded in diameter to the outer side in the first case 455 and is formed in a substantially octagonal shape when viewed along the first rotation axis Rx1. The first case 455 is fixed by a plurality of first fixing members 48 in a state in which the flange 456 is in contact with the side surface of the housing 41 facing the −X direction.

Configuration of the First Fixing Members

A configuration of the plurality of first fixing members 48 is explained.

Each of the plurality of first fixing members 48 is equivalent to the fixing member and fixes the first motor 45, the position of the first rotor 451 of which is adjusted by the adjuster 457, to the housing 41. In this embodiment, each of the plurality of first fixing members 48 is a screw including a shaft 481, which is a screw, and a head 482 provided at an end portion in the shaft 481 and having an outer diameter larger than the outer diameter of the shaft 481. The first fixing members 48 are attached to the first attachment parts 418. In this embodiment, the first attachment parts 418 are screw holes in which the shafts 481 screw. When the first fixing members 48 are attached to the first attachment parts 418, the shafts 481 project in the −X direction from the housing 41. That is, the housing 41 includes the shafts 481 projecting along the first rotation axis Rx1.

The second fixing members that fix the second motor 47 to a side surface of the housing 41 facing the +X direction include the same configuration as the configuration of the first fixing members 48.

Configuration of the Adjusters

The adjusters 457 make it possible to adjust the position of the first rotor 451, which extends along an imaginary plane perpendicular to the first rotation axis Rx1, with respect to the housing 41. That is, the first motor 45 includes the adjusters 457 that make it possible to adjust the position of the first rotor 451 extending along the imaginary plane. The adjusters 457 are provided respectively at corners of the flange 456 when viewed from the −X direction. The adjusters 457 include holes 458.

The holes 458 are provided at corner portions of the flange 456 when viewed along the first rotation axis Rx1 to pierce through the flange 456 in the +X direction. The shafts 481 of the first fixing members 48 are inserted into the holes 458 in the +X direction. That is, the adjusters 457 include the holes 458 into which the shafts 481 are inserted.

The inner diameter of the holes 458 is larger than the outer diameter of the shafts 481 and smaller than the outer diameter of the heads 482. That is, the holes 458 are so-called clearance holes.

The first motor 45 is capable of sliding along an imaginary plane orthogonal to the center axes of the shafts 481 in a state in which the first fixing members 48 are provisionally fixed to the first attachment parts 418. The center axes of the shafts 481 attached to the first attachment parts 418 are substantially parallel to the first rotation axis Rx1 extending along the +X direction. Therefore, in the state in which the first fixing members 48 are provisionally fixed to the first attachment parts 418, the first rotor 451 is capable of sliding along the imaginary plane orthogonal to the first rotation axis Rx1. Consequently, it is possible to adjust the position of the first rotor 451 on the imaginary plane orthogonal to the first rotation axis Rx1.

The first fixing members 48 are fastened after the position of the first rotor 451 is adjusted, whereby the first rotor 451 and the first motor 45 are fixed.

The adjusters 457 are capable of adjusting the position of the first rotor 451 in a range until the outer circumferential surfaces of the shafts 481 come into contact with the inner surfaces of the holes 458. A maximum value of a position adjustment amount of the first rotor 451 by the adjusters 457 is the distance between the first rotor 451 at the time when portions in the moving direction of the first motor 45 come into contact with the shafts 481 on the inner circumferential surfaces of the holes 458 and the position of the first rotor 451 at the time when portions in the opposite direction of the moving direction come into contact with the shafts 481 on the inner circumferential surfaces of the holes 458. Such a maximum value of the adjustment amount is explained in detail below.

Configuration of the Second Motor

The second motor 47 shown in FIG. 2 is fixed to the housing 41 by the second fixing members (not shown) in a state in which the second motor 47 is coupled to the second rotating member 46. The second motor 47 is coupled to the second rotating member 46, rotates, centering on the second rotation axis Rx2 extending in the +X direction, the second rotating member 46 in the opposite direction of the first rotating member 44, and moves the coupling member 43 and the slide member 42 in the ±Y direction together with the first motor 45. The second motor 47 includes the second rotor 471, a second stator 472, a front-end-side bearing 473, a rear end side bearing 474, and a second case 475 that are the same as the first rotor 451, the first stator 452, the front-end-side bearing 453, the rear end side bearing 454, and the first case 455.

The second rotor 471 rotates centering on the second rotation axis Rx2. The second rotor 471 is inserted into the second fitting part 465 of the second rotating member 46 in the −X direction. Consequently, the second rotor 471 is integrated with the second rotating member 46.

The second stator 472 rotates the second rotor 471 centering on the second rotation axis Rx2. The second stator 472 is provided on the outer side of the second rotor 471 when viewed along the second rotation axis Rx2.

The front-end-side bearing 473 is a slide bearing. The front-end-side bearing 473 is provided in the second case 475 and rotatably supports a portion of the second rotor 471 in the −X direction.

The rear end side bearing 474 is a roller bearing. The rear end side bearing 474 is provided in the second case 475 and rotatably supports a portion of the second rotor 471 in the +X direction.

The second case 475 stores the second stator 472, the front-end-side bearing 473, and the rear end side bearing 474 and supports the second rotor 471 rotatably centering on the second rotation axis Rx2. The second case 475 is fixed to the housing 41 by the not-shown second fixing members. Although not shown, the second case 475 includes a flange and adjusters that are the same as the flange 456 and the adjusters 457.

Assembly Method for the Positive Displacement Machine

An assembly process for a general positive displacement machine is explained.

The general positive displacement machine is assembled by, for example, the following procedure. It is assumed that a slide member is already provided in a housing and a coupling member is coupled to the slide member.

First, a first rotor of a first motor and a first rotating member are coupled. Similarly, a second rotor of a second motor and a second rotating member are coupled.

Subsequently, a first end portion of the coupling member is inserted into a first bearing of the first rotating member. Similarly, a second end portion of the coupling member is inserted into a second bearing of the second rotating member. Consequently, the rotating members and the coupling member are coupled.

First fixing members are fastened to fix the first motor to the housing. Second fixing members are fastened to fix the second motor to the housing.

Consequently, the positive displacement machine is assembled.

When the positive displacement machine is assembled in this way, high component accuracy is requested for the components. However, a manufacturing error could occur in the components. Therefore, in order to assemble the components without problems, it is necessary to set backlash in design large considering tolerance of the components. However, if backlash among the components is large, when the assembled positive displacement machine is actually operated, the components collide with one another or a center of gravity position moves. In such a case, vibration at the operation time of the positive displacement machine increases.

On the other hand, if the backlash in design is reduced, deviation between positions of the components in design and actual positions of the components increases to make it difficult to couple the components. Even when the components are successfully coupled, sliding resistance among the components increases and operation efficiency of the positive displacement machine is deteriorated. For example, if sliding resistance of the coupling member against the bearings of the rotating members increases, rotation torque of the rotors necessary for sliding of the coupling member and the slide member increases and motor efficiency is deteriorated. Even when rotation resistance of the rotors against the bearing of the motor increases, rotation torque of the rotor necessary for rotation of the rotating members increases and the motor efficiency is deteriorated.

Adjustment Amount by the Adjusters

In contrast, in the positive displacement machine 4 according to this embodiment, the position of the first rotor 451 and the position of the first motor 45 can be adjusted along the imaginary plane orthogonal to the first rotation axis Rx1 by the adjusters 457 of the first motor 45. The same applies to the second motor 47 including the same adjusters as the adjusters 457.

Therefore, even if the backlash in design is reduced, the first rotating member 44 and the second rotating member 46 can be coupled to the coupling member 43.

At this time, since the maximum value of the position adjustment amount of the first rotor 451 by the adjusters 457 is larger than a cumulative value of backlash that occurs between the first rotating member 44 and the first rotor 451, the first rotor 451 can be disposed in the appropriate position described above. In other words, since the maximum value of the position adjustment amount of the first rotor 451 by the adjusters 457 is larger than a value of a total interval obtained by totaling lengths of maximum intervals between two components in which backlash occurs between the first rotating member 44 and the first rotor 451, the first rotor 451 can be disposed in the appropriate position described above. The same applies to position adjustment for the second rotor 471 by the adjusters of the second motor 47.

Consequently, the rotors 451 and 471 can be disposed in positions where the resistance at the operation time of the positive displacement machine 4 decreases. The vibration at the operation time of the positive displacement machine 4 can be reduced.

Figure 4:
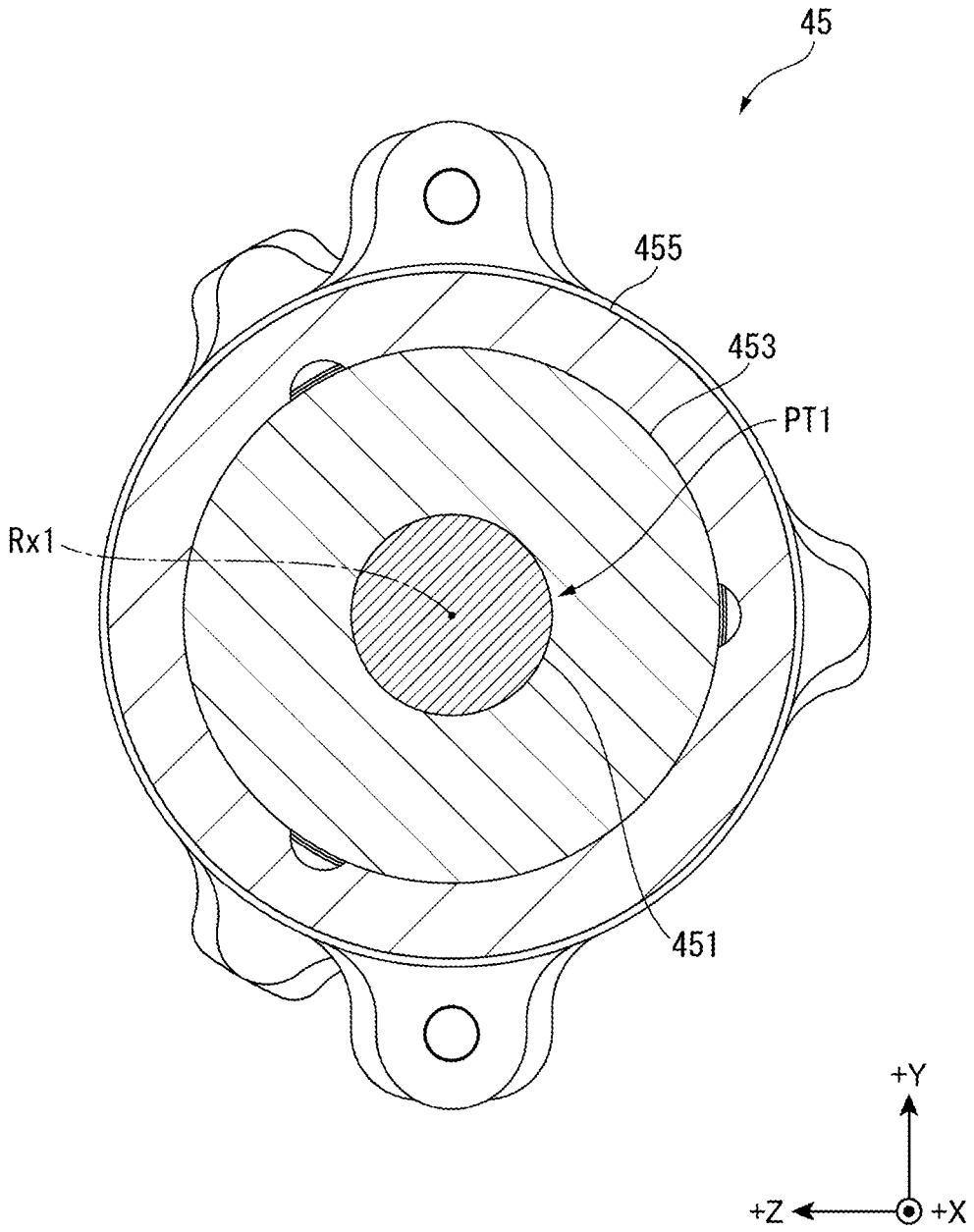
FIG. 4 is a diagram showing a cross section of a positive displacement machine taken along a IV-IV line shown in FIG. 2.

FIG. 4 is a diagram in which a cross section of the positive displacement machine 4 taken along the imaginary plane orthogonal to the first rotation axis Rx1 is viewed from the +X direction. Specifically, FIG. 4 is a diagram in which a cross section of the positive displacement machine 4 taken along the imaginary plane orthogonal to the first rotation axis Rx1 and passing the front-end-side bearing 453 is viewed from the +X direction. That is, FIG. 4 is a diagram showing a cross section of the positive displacement machine 4 taken along a IV-IV line shown in FIG. 2.

In the positive displacement machine 4 according to this embodiment, parts where backlash occurs between the first rotor 451 and the coupling member 43 are three parts explained below. That is, parts where backlash affecting the coupling of the first rotor 451 and the coupling member 43 via the first rotating member 44 are the three parts explained below.

Among the three parts, a first part PT1 is a part between the first rotor 451 and the front-end-side bearing 453 as shown in FIG. 4. When an interval having the largest length among intervals between the outer circumferential surface of the first rotor 451 and the inner circumferential surface of the front-end-side bearing 453 in a direction orthogonal to the first rotation axis Rx1 is represented as a first interval, the first interval is included in the total interval.

Figure 5:
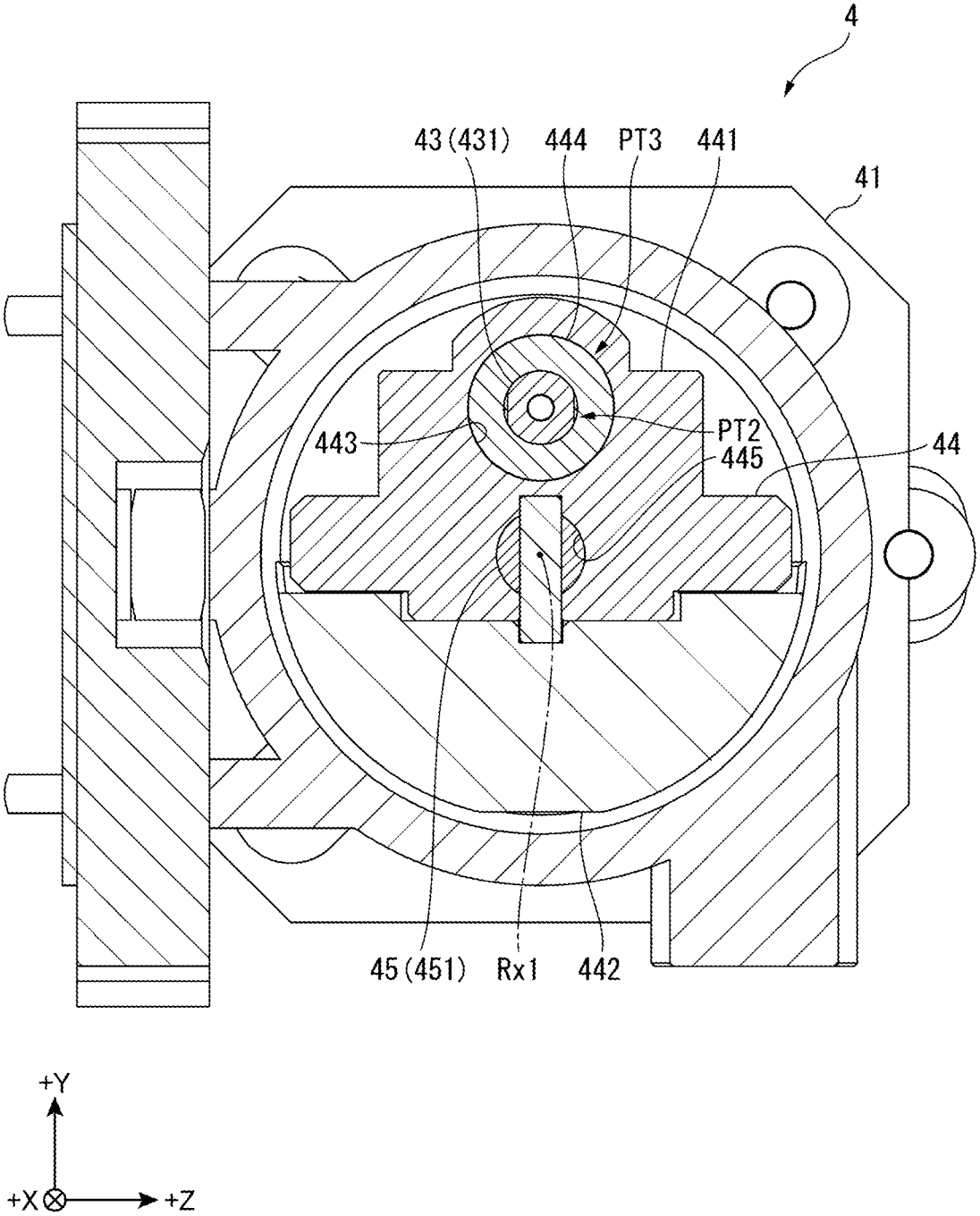
FIG. 5 is a diagram showing a cross section of the positive displacement machine taken along a V-V line shown in FIG. 2.

FIG. 5 is a diagram in which the cross section of the positive displacement machine 4 taken along the imaginary plane orthogonal to the first rotation axis Rx1 is viewed from the −X direction. Specifically, FIG. 5 is a diagram in which a cross section at the time when the coupling member 43 is located in the top dead center, that is, a cross section of the positive displacement machine 4 taken along the imaginary plane orthogonal to the first rotation axis Rx1 and passing the first rotation member 44 is viewed from the −X direction. That is, FIG. 5 is a diagram showing a cross section of the positive displacement machine 4 taken along a V-V line shown in FIG. 2.

Among the three parts, as shown in FIG. 5, a second part PT2 is a part between the outer circumferential surface in the first end portion 431 of the coupling member 43 and the inner surface of the first bearing 444 into which the first end portion 431 is inserted. When an interval having the largest length among intervals between the outer circumferential surface of the first end portion 431 and the inner circumferential surface of the first bearing 444 in the direction orthogonal to the first rotation axis Rx1 is represented as a second interval, the second interval is included in the total interval.

Among the three parts, a third part PT3 is a part between the first bearing 444 and the inner circumferential surface of the first disposing part 443. When an interval having the largest length among intervals between the outer circumferential surface of the first bearing 444 and the inner circumferential surface of the first disposing part 443 in the direction orthogonal to the first rotation axis Rx1 is represented as a third interval, the third interval is included in the total interval.

Since the maximum value of the position adjustment amount of the first rotor 451 by the adjusters 457 is larger than a value of a total interval obtained by totaling the length of the first interval, the length of the second interval, and the length of the third interval, the first rotor 451 can be disposed in the appropriate position described above.

The same applies to the second motor 47.

Figure 6:
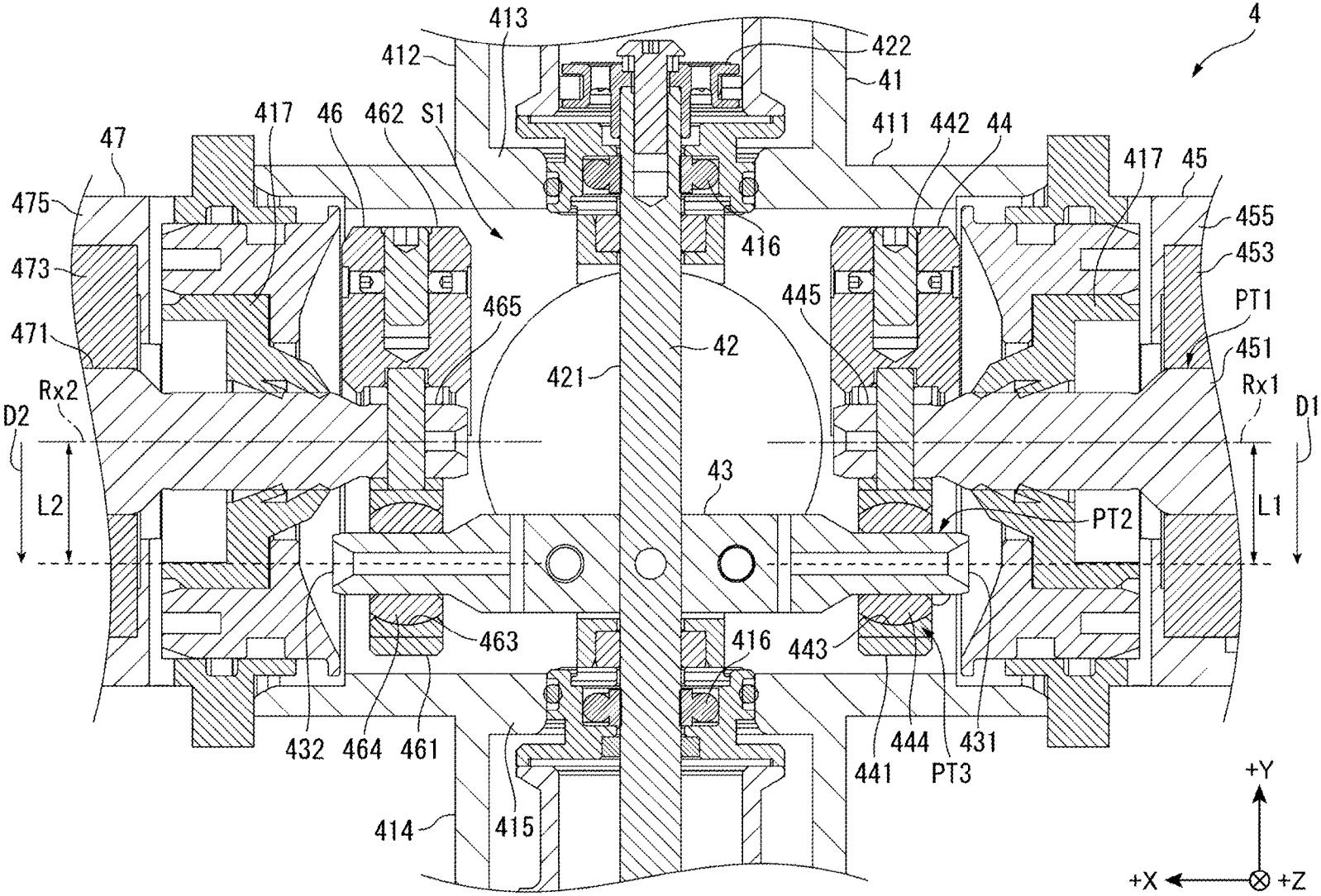
FIG. 6 is a diagram showing an eccentricity amount of a first rotating member and an eccentricity amount of a second rotating member in the first embodiment.

FIG. 6 is a diagram showing an eccentricity amount of the first rotating member 44 and an eccentricity amount of the second rotating member 46.

As shown in FIG. 6, a direction (a third direction) orthogonal to the first rotation axis Rx1 and extending from the first rotation axis Rx1 toward the first bearing 444 is represented as a direction D1. The length of a dimension (a first dimension) between the first rotation axis Rx1 and the center of the first bearing 444 in the direction D1 is represented as length L1. The length L1 is an eccentricity amount of the first rotating member 44.

A direction (a fourth direction) orthogonal to the second rotation axis Rx2 and extending from the second rotation axis Rx2 toward the second bearing 464 is represented as a direction D2. The length of a dimension (a second dimension) between the second rotation axis Rx2 and the center of the second bearing 464 in the direction D2 is represented as length L2. The length L2 is an eccentricity amount of the second rotating member 46.

At this time, the value of the total interval is larger than a difference value between the length L1 and the length L2. That is, the value of the total interval is larger than a difference value between the eccentricity amount of the first rotating member 44 and the eccentricity amount of the second rotating member 46.

Consequently, even when the eccentricity amount of the first rotating member 44 and the eccentricity amount of the second rotating member 46 are different because of a manufacturing error or the like, the first rotor 451 can be disposed in a position where the rotation resistance of the first rotating member 44 decreases and the second rotor 471 can be disposed in a position where the rotation resistance of the second rotating member 46 decreases. Therefore, it is possible to reduce the resistance at the operation time of the positive displacement machine 4 and improve motor efficiency of the first motor 45 and the second motor 47.

Effects of the First Embodiment

The electronic equipment 1 according to this embodiment explained above achieves the following effects.

The electronic equipment 1 includes the cooling apparatus 2.

The cooling apparatus 2 includes the compressor 3, the condenser 21, the expander 22, and the evaporator 23. The condenser 21 condenses working fluid in a gas phase compressed by the compressor 3 into the working fluid in a liquid phase. The expander 22 decompresses the working fluid in the liquid phase condensed by the condenser 21 and changes a state of the working fluid to a state in which the liquid phase and the gas phase are mixed. The evaporator 23 is coupled to the cooling target CT to be capable of transferring heat. The evaporator 23 changes the working fluid flowing from the expander 22 to the working fluid in the gas phase with the heat transferred from the cooling target CT and discharges the changed working fluid in the gas phase to the compressor 3.

The compressor 3 includes the positive displacement machine 4 and compresses the working fluid in the gas phase. Specifically, the first piston 422 of the positive displacement machine 4 compresses gas flowing into the first pressure chamber S2 and the second piston 423 compresses gas flowing into the second pressure chamber S4. The first piston 422 and the second piston 423 are equivalent to the piston.

The positive displacement machine 4 includes the housing 41, the slide member 42, the coupling member 43, the first rotating member 44, and the first motor 45.

The housing 41 includes the tubular first guide part 412 in which the first pressure chamber S2 is provided and the tubular second guide part 414 in which the second pressure chamber S4 is provided.

The slide member 42 includes the first piston 422 disposed in the first guide part 412 and the second piston 423 disposed in the second guide part 414 and slides in the +Y direction. The +Y direction is equivalent to the first direction.

The coupling member 43 is coupled to the slide member 42 and extends in the +X direction crossing the +Y direction. The +X direction is equivalent to the second direction.

The first rotating member 44 is coupled to the first end portion 431 of the coupling member 43 and rotates centering on the rotation axis Rx1 extending in the +X direction. The first end portion 431 is equivalent to one end of the coupling member 43.

The first motor 45 includes the first rotor 451 and the adjusters 457. The first rotor 451 is coupled to the first rotating member 44 and rotates centering on the first rotation axis Rx1. The adjusters 457 make it possible to adjust the position of the first rotor 451, which extends along the imaginary plane perpendicular to the first rotation axis Rx1, with respect to the housing 41.

With such a configuration, the position of the first rotor 451 extending along the imaginary plane perpendicular to the first rotation axis Rx1 can be adjusted by the adjusters 457. Accordingly, since the position of the first rotor 451 coupled to the first rotating member 44 coupled to the coupling member 43 can be adjusted, it is possible to make it easy to combine the coupling member 43, the first rotating member 44, and the first rotor 451. Therefore, it is possible to improve assemblability of the positive displacement machine 4.

By optimizing the position of the first rotor 451, it is possible to configure the compressor 3 capable of reducing vibration at a gas compression time. Consequently, it is possible to configure the cooling apparatus 2 and the electronic equipment 1 capable of reducing vibration at an operation time.

In the positive displacement machine 4, the first rotating member 44 includes the first bearing 444 that supports the first end portion 431 of the coupling member 43 and the first disposing part 443 provided on the inside of the first bearing 444.

The first motor 45 includes the front-end-side bearing 453. The front-end-side bearing 453 is equivalent to the rotor-side bearing. The front-end-side bearing 453 is disposed on the outer side of the first rotor 451 when viewed along the first rotation axis Rx1 and rotatably supports the first rotor 451.

An interval having the largest length among intervals between the outer circumferential surface of the first rotor 451 and the inner circumferential surface of the front-end-side bearing 453 is represented as a first interval. An interval having the largest length among intervals between the outer circumferential surface of the first end portion 431 and the inner circumferential surface of the first bearing 444 is represented as a second interval. An interval having the largest length among intervals between the outer circumferential surface of the first bearing 444 and the inner circumferential surface of the first disposing part 443 is represented as a third interval. A maximum value of a position adjustment amount of the first rotor 451 by the adjusters 457 is larger than a value of a total interval obtained by totaling the length of the first interval, the length of the second interval, and the length of the third interval.

In order to appropriately drive the positive displacement machine, it is necessary to appropriately combine the coupling member, the first rotating member, and the first rotor. However, a manufacturing error sometimes occurs among the components. In contrast, it is conceivable to increase backlash in design and ensure a combination of the components.

However, if the backlash in design is increased, although it is possible to make it easy to combine the components, since backlash that occurs among the components is large, if the combined positive displacement machine is operated, vibration at an operation time increases and noise increases.

On the other hand, in the configuration of the positive displacement machine 4 explained above, backlash occurs between the first rotor 451 and the front-end-side bearing 453, between the first end portion 431 of the coupling member 43 and the first bearing 444, and between the first bearing 444 and the first disposing part 443.

In contrast, the maximum value of the position adjustment amount of the first rotor 451 by the adjusters 457 is larger than the value of the total interval. Consequently, even if backlash in design is reduced, easiness in combination of the components can be ensured by position adjustment for the first rotor 451 by the adjusters 457. Therefore, since the backlash in design can be reduced, it is possible to reduce vibration at the operation time of the combined positive displacement machine 4 and reduce the noise at the operation time of the positive displacement machine 4.

The positive displacement machine 4 includes the second rotating member 46 and the second motor 47.

The second rotating member 46 is coupled to the second end portion 432 of the coupling member 43 on the opposite side of the first end portion 431 and rotates, centering on the second rotation axis Rx2 extending in the +X direction, in the opposite direction of the rotating direction of the first rotating member 44. The second rotating member 46 includes the second bearing 464 that supports the second end portion 432 and the second disposing part 463 in which the second bearing 464 is provided. The second motor 47 is coupled to the second rotating member 46.

A direction orthogonal to the first rotation axis Rx1 and extending from the first rotation axis Rx1 toward the first bearing 444 is the direction D1. A direction orthogonal to the second rotation axis Rx2 and extending from the second rotation axis Rx2 toward the second bearing 464 is the direction D2. The direction D1 is equivalent to the third direction. The direction D2 is equivalent to the fourth direction. A dimension between the first rotation axis Rx1 and the center of the first bearing 444 in the direction D1 is represented as the length L1. A dimension between the second rotation axis Rx2 and the center of the second bearing 464 in the direction D2 is represented as the length L2.

In this case, the value of the total interval is larger than a difference value between the length L1 and the length L2.

A manufacturing error can occur not only in the first rotating member 44 but also in the second rotating member 46. If the length L1 and the length L2 are different, backlash occurs even when the first rotation axis Rx1 and the second rotation axis Rx2 are disposed in positions in design. Vibration at the rotation time of the rotating members 44 and 46 increases.

In contrast, since the value of the total interval is larger than the difference value between the length L1 and the length L2 and the maximum value of the position adjustment amount of the first rotor 451 by the adjusters 457 is larger than the value of the total interval, taking into account the difference value between the length L1 and the length L2 as well, the first rotor 451 can be disposed in a position where vibration of the positive displacement machine 4 decreases. Therefore, it is possible to further reduce the vibration and the noise at the operation time of the positive displacement machine 4.

In the positive displacement machine 4, since the first fixing members 48 are attached to the housing 41, the housing 41, which is one of the housing 41 and the adjusters 457, includes the shafts 481 projecting along the first rotation axis Rx1. The adjusters 457, which are the other of the housing 41 and the adjusters 457, include the holes 458 into which the shafts 481 are inserted. The holes 458 are clearance holes, the inner diameter of which is larger than the outer diameter the shafts 481. The adjusters 457 are capable of adjusting the position of the first rotor 451 in a range until the outer circumferential surfaces of the shafts 481 come into contact with the inner surfaces of the holes 458.

With such a configuration, it is possible to adjust the position of the first rotor 451 in the range until the outer circumferential surfaces of the shafts 481 projecting along the first rotation axis Rx1 the inner surfaces of the holes 458, which are the clearance holes, come into contact with each other. Therefore, it is possible to adjust the position of the first rotor 451 on the imaginary plane perpendicular to the first rotation axis Rx1.

The positive displacement machine 4 includes the first fixing members 48 that fix the first motor 45, the position of the first rotor 451 of which is adjusted by the adjusters 457, to the housing 41. The first fixing members 48 are equivalent to the fixing member.

With such a configuration, the first motor 45, the position of the first rotor 451 of which is adjusted, can be fixed to the housing 41 by the first fixing members 48. Therefore, it is possible to maintain the adjusted position of the first rotor 451.

In the positive displacement machine 4, the housing 41 includes the first attachment parts 418 to which the first fixing members 48 are attached. The first attachment parts 418 are equivalent to the attachment part.

The first fixing members 48 include the shafts 481 and the heads 482. The shafts 481 are attached to the first attachment parts 418 and project from the housing 41. The heads 482 are provided at the end portions of the shafts 481 and have an outer diameter larger than the outer diameter of the shafts 481. The holes 458 of the adjusters 457 have an inner diameter larger than the outer diameter of the shafts 481 and smaller than the outer diameter of the heads 482.

With such a configuration, since the shafts 481 of the first fixing members 48 can be used, it is unnecessary to separately provide shafts inserted into the holes 458. Besides, it is possible to make it easy to fix the first motor 45, the position of the first rotor 451 of which is adjusted, to the housing 41. Therefore, it is possible to simplify the configuration of the positive displacement machine 4. Besides, it is possible to make it easy to implement position adjusting operation for the first rotor 451 and fixing operation for the first motor 45 to the housing 41.

Second Embodiment

Subsequently, a second embodiment of the present disclosure is explained.

Electronic equipment according to this embodiment includes the same configuration as the configuration of the electronic equipment 1 according to the first embodiment but is different in a configuration of a positive displacement machine configuring a compressor. In the following explanation, the same or substantially the same portions as the portions explained above are denoted by the same reference numerals and signs and explanation of the portions is omitted.

Configurations of the Electronic Equipment and a Cooling Apparatus

Figure 7:
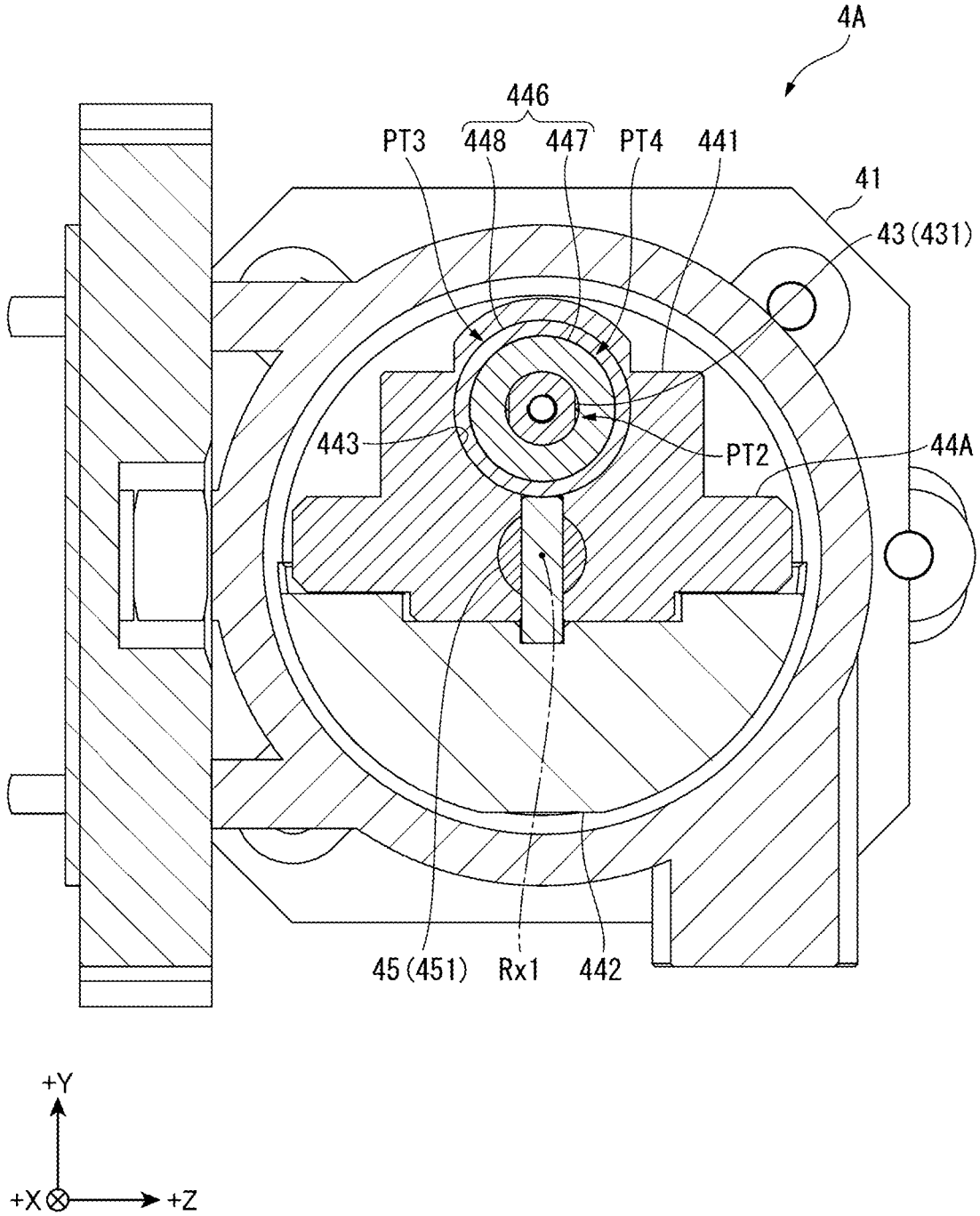
FIG. 7 is a sectional view enlarging and showing a part of a positive displacement machine included in electronic equipment in a second embodiment.

FIG. 7 is a sectional view enlarging and showing a part of a positive displacement machine 4A included in the electronic equipment according to this embodiment. Specifically, FIG. 7 is a diagram enlarging and showing a part of a cross section of the positive displacement machine taken along an XY plane in a disposition position of a first rotating member 44A.

The electronic equipment and a cooling apparatus according to this embodiment include the same components and the same functions as the components and the functions of the electronic equipment 1 and the cooling apparatus 2 according to the first embodiment except that the electronic equipment and the cooling apparatus according to this embodiment include the positive displacement machine 4A shown in FIG. 7 instead of the positive displacement machine 4. That is, the compressor 3 according to this embodiment includes the positive displacement machine 4A instead of the positive displacement machine 4.

The positive displacement machine 4A includes the same components and the same functions as the components and the functions of the positive displacement machine 4 except that the positive displacement machine 4A includes the first rotating member 44A instead of the first rotating member 44. That is, the positive displacement machine 4A includes the housing 41, the slide member 42, the coupling member 43, the first rotating member 44A, the first motor 45, the second rotating member 46, the second motor 47, the first fixing members 48, and the second fixing members (not shown). The second rotating member 46 included in the positive displacement machine 4A includes the same components as the components of the first rotating member 44A. Therefore, explanation about the second rotating member 46 according to this embodiment is omitted.

Configuration of the First Rotating Member

Like the first rotating member 44, the first rotating member 44A is coupled to the first end portion 431 of the coupling member 43 and the first rotor 451 of the first motor 45. The first rotating member 44A rotates centering on the first rotation axis Rx1 together with the first rotor 451 to move the coupling member 43 in the ±Y direction. The first rotating member 44A includes the same components as the components of the first rotating member 44 according to the first embodiment except that the first rotating member 44A includes a first bearing 446 instead of the first bearing 444.

The first bearing 446 is a spherical slide bearing into which the first end portion 431 is inserted. The first bearing 446 includes a first member 447 into which the first end portion 431 is inserted in the −X direction and a second member 448 that slidably supports the first member 447.

The first member 447 supports the inserted first end portion 431.

The second member 448 is separate from the first member 447. The second member 448 is disposed on the outer side of the first member 447 when viewed from the +X direction. The outer circumferential surface in the second member 448 is fixed to the inner surface of the first disposing part 443. That is, the second member 448 is disposed on the inside of the first disposing part 443 and rotatably supports the first member 447.

Adjustment Amount by the Adjusters

A total interval in this embodiment includes, in addition to the total interval according to the first embodiment, an interval having the largest length among intervals between the outer circumferential surface of the first member 447 and the inner circumferential surface of the second member 448. That is, in the positive displacement machine 4A, a part where backlash affecting coupling of the first rotor 451 and the coupling member 43 via the first rotating member 44 occurs includes a fourth part PT4 in addition to the first part PT1, the second part PT2, and the third part PT3.

The fourth part PT4 is a part between the first member 447 and the second member 448. The interval having the largest length among the intervals between the outer circumferential surface of the first member 447 and the inner circumferential surface of the second member 448 is included in the total interval.

That is, a value of the total interval in this embodiment is a value of an interval obtained by totaling the length of a largest first interval among intervals between the outer circumferential surface of the first rotor 451 and the inner circumferential surface of the front-end-side bearing 453, the length of a largest second interval among intervals between the outer circumferential surface of the first end portion 431 and the inner circumferential surface of the first member 447, the length of a largest third interval among intervals between the outer circumferential surface of the first member 447 and the inner circumferential surface of the second member 448, and the length of a largest fourth interval among intervals between the outer circumferential surface of the second member 448 and the inner circumferential surface of the first disposing part 443.

Since the maximum value of the position adjustment amount of the first rotor 451 by the adjusters 457 is larger than the value of the total interval, the first rotor 451 can be disposed in the appropriate position explained above. The length of the total interval is larger than a difference value between the length L1 and the length L2.

Effects of the Second Embodiment

The electronic equipment according to this embodiment explained above have the following effects besides having the same effects as the effects of the electronic equipment according to the first embodiment.

In the positive displacement machine 4A, the first rotating member 44A includes the first bearing 446 that supports the first end portion 431 of the coupling member 43 and the first disposing part 443 provided on the inside of the first bearing 446. The first bearing 446 includes the first member 447 and the second member 448. The first end portion 431 is inserted into the first member 447. The second member 448 is disposed on the inside of the first disposing part 443 and rotatably supports the first member 447.

The first motor 45 includes the front-end-side bearing 453. The front-end-side bearing 453 is equivalent to the rotor-side bearing. The front-end-side bearing 453 is disposed on the outer side of the first rotor 451 when viewed along the first rotation axis Rx1 and rotatably supports the first rotor 451. A maximum value of a position adjustment amount of the first rotor 451 by the adjusters 457 is larger than a value of a total interval obtained by totaling the length of a first interval, the length of a second interval, the length of a third interval, and the length of a fourth interval.

The first interval is an interval having the largest length among intervals between the outer circumferential surface of the first rotor 451 and the inner circumferential surface of the front-end-side bearing 453. The second interval is an interval having the largest length among intervals between the outer circumferential surface of the first end portion 431 and the inner circumferential surface of the first member 447. The third interval is an interval having the largest length among intervals between the outer circumferential surface of the first member 447 and the inner circumferential surface of the second member 448. The fourth interval is an interval having the largest length among intervals between the outer circumferential surface of the second member 448 and the inner circumferential surface of the first disposing part 443.

As explained above, if backlash in design in the positive displacement machine is increased, it is possible to make it easy to combine the components. However, since backlash that occurs among the components is large, vibration and noise at an operation time of the positive displacement machine increase.

On the other hand, backlash occurs between the first rotor 451 and the front-end-side bearing 453, between the first end portion 431 of the coupling member 43 and the first member 447 of the first bearing 446, between the first member 447 and the second member 448, and between the second member 448 and the first disposing part 443.

In contrast, the maximum value of the position adjustment amount of the first rotor 451 by the adjusters 457 is larger than the value of the total interval. Consequently, even if the backlash in design is reduced, easiness in combination of the components can be ensured by position adjustment for the first rotor 451 by the adjusters 457. Therefore, since the backlash in design can be reduced, it is possible to reduce vibration and noise at the operation time of the combined positive displacement machine 4A.

Modifications of the Embodiments

The present disclosure is not limited to the embodiments explained above. Modifications, improvements, and the like in a range in which the object of the present disclosure can be achieved are included in the present disclosure.

In the embodiments, the first motor 45 includes the adjusters 457 and the second motor 47 includes the same adjusters as the adjusters 457. However, not only this, but one motor of the first motor 45 and the second motor 47 may include adjusters.

The positive displacement machines 4 and 4A include a set of the first rotating member 44 and the first motor 45 and a set of the second rotating member 46 and the second motor 47. However, not only this, but a positive displacement machine may include only one set of the set of the first rotating member 44 and the first motor 45 and the set of the second rotating member 46 and the second motor 47.

In the embodiments explained above, the maximum value of the position adjustment amount of the first rotor 451 by the adjusters 457 is larger than the value of the total interval. However, not only this, but the maximum value of the position adjustment amount of the first rotor 451 by the adjusters 457 may be equal to or smaller than the value of the total interval. The same applies to the adjusters included in the second motor 47.

In the embodiments explained above, the value of the total interval is larger than the difference value between the eccentricity amount of the first rotating member 44 and the eccentricity amount of the second rotating member 46. That is, the value of the total interval is larger than the difference value between the length L1 and the length L2. However, not only this, but the value of the total interval may be equal to or smaller than the difference value between the eccentricity amount of the first rotating member 44 and the eccentricity amount of the second rotating member 46.

In the embodiments explained above, since the first fixing members 48 are attached to the first attachment parts 418, the housing 41 includes the shafts 481 projecting from the housing 41. However, not only this, but the housing 41 may include, separately from the first fixing members 48, shafts inserted into the holes 458 included in the adjusters 457. In this case, the first fixing members 48 may be fastened to the shafts inserted into the holes 458 or may be attached to other portions of the housing 41 and the first motor 45. The same applies to the second fixing members.

In the embodiments explained above, the housing 41 includes the shafts 481 and the adjusters 457 include the holes 458 into which the shafts 481 are inserted. However, not only this, but the adjusters 457 may include shafts projecting toward the housing 41 and the housing 41 may include holes, recesses, or grooves into which the shafts are inserted.

In the embodiments explained above, the first fixing members 48 are the screws including the shafts 481 and the heads 482. However, not only this, but the first fixing members 48 are not limited to the screws and may include another configuration if the position of the first rotor 451 can be fixed with respect to the housing 41. For example, the first motor 45 may be fixed to the housing 41 by a fixing method such as bonding, welding, caulking, or brazing. The same applies to the second motor 47 and the second fixing members.

In the embodiments explained above, the front-end-side bearings 453 and 473 functioning as the rotor-side bearing are the slide bearings. However, not only this, but the front-end-side bearings 453 and 473 may be roller bearings. When the front-end-side bearing 453 is the roller bearing, the inner ring of the front-end-side bearing 453 is fixed to the outer circumferential surface of the first rotor 451 and the outer ring of the front-end-side bearing 453 is fixed to the first case 455. Backlash between the inner ring and the outer ring can be reduced to substantially zero by applying a pre-load to the front-end-side bearing 453. Therefore, when the roller bearing is adopted as the front-end-side bearing 453, the interval having the largest length among the intervals between the outer circumferential surface of the first rotor 451 and the inner circumferential surface of the front-end-side bearing 453 can be reduced to zero.

In the embodiments explained above, the first case 455 of the first motor 45 includes the flange 456 and the adjusters 457 and the adjusters 457 are provided in the flange 456. However, not only this, but the first case 455 may not include the flange 456. The positions of the adjusters 457 in the first case 455 are not limited to the positions explained above.

The positive displacement machine 4 may include at least one adjusting mechanism of a first adjusting mechanism that finely adjusts the position of the first rotor 451 on the imaginary plane orthogonal to the first rotation axis Rx1 and a second adjusting mechanism that finely adjusts the position of the second rotor 471 on the imaginary plane orthogonal to the second rotation axis Rx2.

In the embodiments explained above, the slide member 42 includes the first piston 422 provided at the end portion in the +Y direction in the rod 421 and the second piston 423 provided at the end portion on the opposite side of the first piston 422 in the rod 421. However, not only this, but the slide member 42 may include one piston of the first piston 422 and the second piston 423. In this case, when the slide member 42 does not include, for example, the second piston 423, in the housing 41 of the positive displacement machine 4, the second guide part 414, the second segmenting part 415, the second pressure chamber S4, and the second working chamber S5 can be omitted.

In the embodiments explained above, the positive displacement machines 4 and 4A configure the compressor 3. However, the present disclosure may be applied to a positive displacement machine configuring a generator. That is, the positive displacement machine of the present disclosure is not limited to a positive displacement machine configuring a compressor that compresses gas.

In the embodiments explained above, the compressor 3 compresses the working fluid that changes in phase between the liquid phase and the gas phase. However, the gas compressed by the compressor of the present disclosure is not limited to the working fluid functioning as coolant. The compressor 3 configures the cooling apparatus 2. However, not only this, but the compressor of the present disclosure may configure another device or may be used alone.

Summary of the Present Disclosure

A summary of the present disclosure is noted below.

[1]A positive displacement machine according to a first aspect of the present disclosure includes: a housing including a tubular guide part in which a pressure chamber is provided; a slide member including a piston disposed in the guide part, the slide member sliding in a first direction; a coupling member coupled to the slide member and extending in a second direction crossing the first direction; a first rotating member coupled to a first end portion of the coupling member and configured to rotate centering on a first rotation axis extending in the second direction; and a first motor. The first motor includes: a first rotor coupled to the first rotating member and configured to rotate centering on the first rotation axis; and an adjuster configured to make it possible to adjust a position of the first rotor, which extends along an imaginary plane perpendicular to the first rotation axis, with respect to the housing.

With such a configuration, the position of the first rotor extending along the imaginary plane perpendicular to the first rotation axis can be adjusted by the adjuster. Accordingly, since the position of the first rotor coupled to the first rotating member engaged with the coupling member can be adjusted, it is possible to make it easy to combine the coupling member, the first rotating member, and the first rotor. Therefore, it is possible to improve assemblability of the positive displacement machine.

[2] In the positive displacement machine described in [1], the first rotating member may include: a first bearing configured to support the first end portion; and a first disposing part in which the first bearing is provided, the first motor may include a rotor-side bearing disposed on an outer side of the first rotor when viewed along the first rotation axis and configured to rotatably support the first rotor, and a maximum value of a position adjustment amount of the first rotor by the adjuster may be larger than a value of a total interval obtained by totaling length of a largest first interval between an outer circumferential surface of the first rotor and an inner circumferential surface of the rotor-side bearing, length of a largest second interval between an outer circumferential surface of the first end portion and an inner circumferential surface of the first bearing, and length of a largest third interval between an outer circumferential surface of the first bearing and an inner circumferential surface of the first disposing part.

As explained above, in order to appropriately drive the positive displacement machine, it is necessary to appropriately combine the first rotor, the first rotating member, and the coupling member. However, a manufacturing error sometimes occurs among the components. In contrast, it is conceivable to increase backlash in design and ensure the combination of the components.

However, if the backlash in design is increased, although it is possible to make it easy to combine the components, since backlash that occurs among the components is large, if the combined positive displacement machine is operated, vibration at the operation time increases and noise increases.

On the other hand, in the configuration explained above, backlash occurs between the first rotor and the rotor-side bearing, between the first end portion of the coupling member and the first bearing, and between the first bearing and the first disposing part.

In contrast, the maximum value of the position adjustment amount of the first rotor by the adjuster is larger than the value of the total interval. Consequently, even if backlash in design is reduced, easiness in combination of the components can be ensured by position adjustment for the first rotor by the adjuster. Therefore, since the backlash in design can be reduced, it is possible to reduce vibration at the operation time of the combined positive displacement machine and reduce the noise at the operation time of the positive displacement machine.

[3] In the positive displacement machine described in [1], the first rotating member may include: a first bearing configured to support the first end portion; and a first disposing part in which the first bearing is provided, the first bearing may include: a first member into which the first end portion is inserted; and a second member separate from the first member, disposed on an inside of the first disposing part, and configured to rotatably support the first member, the first motor may include a rotor-side bearing disposed on an outer side of the first rotor when viewed along the first rotation axis and configured to rotatably support the first rotor, and a maximum value of a position adjustment amount of the first rotor by the adjuster may be larger than a value of a total interval obtained by totaling length of a largest first interval between an outer circumferential surface of the first rotor and an inner circumferential surface of the rotor-side bearing, length of a largest second interval between an outer circumferential surface of the first end portion and an inner circumferential surface of the first member, length of a largest third interval between an outer circumferential surface of the first member and an inner circumferential surface of the second member, and length of a largest fourth interval between an outer circumferential surface of the second member and an inner circumferential surface of the first disposing part.

As explained above, if the backlash in design in the positive displacement machine is increased, although it is possible to make it easy to combine the components, since backlash that occurs among the components is large, vibration and noise at the operation time of the positive displacement machine increase.

On the other hand, in the configuration explained above, backlash occurs between the first rotor and the rotor-side bearing, between the first end portion of the coupling member and the first member of the first bearing, between the first member and the second member, and between the second member and the first disposing part.

In contrast, the maximum value of the position adjustment amount of the first rotor by the adjuster is larger than the value of the total interval. Consequently, even if backlash in design is reduced, easiness in combination of the components can be ensured by position adjustment for the first rotor by the adjusters. Therefore, since the backlash in design can be reduced, it is possible to reduce vibration at the operation time of the combined positive displacement machine and reduce the noise at the operation time of the positive displacement machine.

[4] In the positive displacement machine described in [2] or [3], the positive displacement machine may further include: a second rotating member coupled to a second end portion of the coupling member on an opposite side of the first end portion and configured to rotate, centering on a second rotation axis extending along the second direction, in an opposite direction of a rotating direction of the first rotating member; and a second motor coupled to the second rotating member, the second rotating member may include: a second bearing configured to support the second end portion; and a second disposing part in which the second bearing is provided, a direction orthogonal to the first rotation axis and extending from the first rotation axis toward the first bearing may be a third direction, a direction orthogonal to the second rotation axis and extending from the second rotation axis toward the second bearing may be a fourth direction, and the value of the total interval may be larger than a difference value between length between the first rotation axis and a center of the first bearing in the third direction and length between the second rotation axis and a center of the second bearing in the fourth direction.

A manufacturing error can occur not only in the first rotating member but also in the second rotating member. If the length between the first rotation axis and the center of the first bearing in the third direction and the length between the second rotation axis and the center of the second bearing in the fourth direction are different, backlash occurs even when the first rotation axis and the second rotation axis are disposed in positions in design. Vibration at the rotation time of the rotating members increases.

In contrast, since the value of the total interval is larger than the difference value and the maximum value of the position adjustment amount of the first rotor by the adjuster is larger than the value of the total interval, taking into account the difference value as well, the first rotor can be disposed in a position where the vibration of the positive displacement machine decreases. Therefore, it is possible to further reduce vibration and noise at the operation time of the positive displacement machine.

[5] In the positive displacement machine described in any one of [1] to [4], one of the housing and the adjuster may include a shaft projecting along the first rotation axis, another of the housing and the adjuster may include a hole into which the shaft is inserted, the hole may be a clearance hole, an inner diameter of which is larger than an outer diameter the shaft, and the adjuster may be configured to adjust a position of the first rotor in a range until an outer circumferential surface of the shaft comes into contact with an inner surface of the hole.

With such a configuration, it is possible to adjust the position of the first rotor in a range until the outer circumferential surface of the shaft projecting along the first rotation axis and the inner circumferential surface of the hole, which is the clearance hole, come into contact. Therefore, it is possible to adjust the position of the first rotor on the imaginary plane perpendicular to the first rotation axis.

[6] In the positive displacement machine described in [5], the positive displacement machine may include a fixing member configured to fix the first motor, the position of the first rotor of which is adjusted by the adjuster, to the housing.

With such a configuration, the first motor, the position of the first rotor of which is adjusted, can be fixed to the housing by the fixing member. Therefore, it is possible to maintain the adjusted position of the first rotor.

[7] In the positive displacement machine described in [6], the housing may include an attachment part to which the fixing member is attached, the fixing member may include: the shaft attached to the attachment part and projecting from the housing; and a head provided at an end portion of the shaft and having an outer diameter larger than an outer diameter of the shaft, and the adjuster may include the hole having an inner diameter larger than the outer diameter of the shaft and smaller than the outer diameter of the head.

With such a configuration, since the shaft of the fixing member can be used, it is unnecessary to separately provide a shaft inserted into the hole. Besides, it is possible to make it easy to fix the first motor, the position of the first rotor of which is adjusted, to the housing. Therefore, it is possible to simplify the configuration of the positive displacement machine. Besides, it is possible to make it easy to implement position adjusting operation for the first rotor and fixing operation for the first motor to the housing.

[8]A compressor according to a second aspect of the present disclosure includes the positive displacement machine described in any one of [1] to [7]. The piston compresses gas flowing into the pressure chamber.

With such a configuration, it is possible to achieve the same effects as the effects of the positive displacement machine according to the first aspect. Therefore, it is possible to configure a compressor capable of reducing vibration at a gas compression time.

[9]A cooling apparatus according to a third aspect of the present disclosure includes: the compressor described in [8] configured to compress working fluid in a gas phase; a condenser configured to condense the working fluid in the gas phase compressed by the compressor into the working fluid in a liquid phase; an expander configured to decompress the working fluid in the liquid phase condensed by the condenser and change a state of the working fluid to a state in which the liquid phase and the gas phase are mixed; and an evaporator coupled to a cooling target to transfer heat and configured to change the working fluid flowing from the expander to the working fluid in the gas phase with the heat transferred from the cooling target and discharge the changed working fluid in the gas phase to the compressor.

With such a configuration, it is possible to achieve the same effects as the effects of the compressor according to the second aspect. It is possible to configure a cooling apparatus capable of reducing vibration at an operation time.

[10] Electronic equipment according to a fourth aspect of the present disclosure includes the cooling apparatus described in [9].

With such a configuration, it is possible to achieve the same effects as the effects of the cooling apparatus according to the third aspect. It is possible to configure electronic equipment capable of reducing vibrating at an operation time.

What is claimed is:

1. A positive displacement machine comprising:

a housing including a tubular guide part in which a pressure chamber is provided;

a slide member including a piston disposed in the guide part, the slide member sliding in a first direction;

a coupling sleeve receiving the slide member and extending in a second direction intersecting the first direction;

a first rotating member coupled to a first end portion of the coupling sleeve and rotating centering on a first rotation axis extending in the second direction; and a first motor, wherein the first motor includes:

a first rotor coupled to the first rotating member and rotating centering on the first rotation axis; and an adjuster plate to adjust a position of the first rotor with respect to the housing, the position extending along an imaginary plane perpendicular to the first rotation axis, the first rotating member includes:

a first bearing supporting the first end portion; and a first disposing part in which the first bearing is provided, the first motor includes a rotor-side bearing disposed on an outer side of the first rotor when viewed along the first rotation axis and rotatably supporting the first rotor, and a maximum value of a position adjustment amount of the first rotor by the adjuster plate is larger than a value of a total interval obtained by totaling three respective intervals, comprising a first interval which is a largest first distance between an outer circumferential surface of the first rotor and an inner circumferential surface of the rotor-side bearing, a second interval which is a largest second distance between an outer circumferential surface of the first end portion and an inner circumferential surface of the first bearing, and a third interval which is a largest third distance between an outer circumferential surface of the first bearing and an inner circumferential surface of the first disposing part.

2. The positive displacement machine according to claim 1, wherein the first rotating member includes:

a first bearing configured to support the first end portion; and a first disposing part in which the first bearing is provided, the first bearing includes:

a first member into which the first end portion is inserted; and a second member separate from the first member, disposed on an inside of the first disposing part, and configured to rotatably support the first member, the first motor includes a rotor-side bearing disposed on an outer side of the first rotor when viewed along the first rotation axis and configured to rotatably support the first rotor, and a maximum value of a position adjustment amount of the first rotor by the adjuster is larger than a value of a total distance obtained by totaling a largest first distance between an outer circumferential surface of the first rotor and an inner circumferential surface of the rotor-side bearing, a largest second distance between an outer circumferential surface of the first end portion and an inner circumferential surface of the first member, a largest third distance between an outer circumferential surface of the first member and an inner circumferential surface of the second member, and a largest fourth distance between an outer circumferential surface of the second member and an inner circumferential surface of the first disposing part.

3. The positive displacement machine according to claim 1, further comprising:

a second rotating member coupled to a second end portion of the coupling sleeve to rotate on an opposite side of the first end portion, centering on a second rotation axis extending along the second direction, in an opposite direction of a rotating direction of the first rotating member; and a second motor coupled to the second rotating member, wherein the second rotating member includes:

a second bearing supporting the second end portion; and a second disposing part in which the second bearing is provided, a third direction is a direction orthogonal to the first rotation axis and extending from the first rotation axis toward the first bearing, and a fourth direction is a direction orthogonal to the second rotation axis and extending from the second rotation axis toward the second bearing, and the value of the total distance is larger than a difference value between a length between the first rotation axis and a center of the first bearing in the third direction and a length between the second rotation axis and a center of the second bearing in the fourth direction.

4. The positive displacement machine according to claim 2, further comprising:

a second rotating member coupled to a second end portion of the coupling member on an opposite side of the first end portion and configured to rotate, centering on a second rotation axis extending along the second direction, in an opposite direction of a rotating direction of the first rotating member; and a second motor coupled to the second rotating member, wherein the second rotating member includes:

a second bearing configured to support the second end portion; and a second disposing part in which the second bearing is provided, a third direction is a direction orthogonal to the first rotation axis and extending from the first rotation axis toward the first bearing, and a fourth direction is a direction orthogonal to the second rotation axis and extending from the second rotation axis toward the second bearing, and the value of the total distance is larger than a difference value between a length between the first rotation axis and a center of the first bearing in the third direction and a length between the second rotation axis and a center of the second bearing in the fourth direction.

5. The positive displacement machine according to claim 1, wherein one of the housing and the adjuster plate includes a shaft projecting along the first rotation axis, another of the housing and the adjuster plate includes a hole into which the shaft is inserted, the hole is a clearance hole, an inner diameter of the hole being larger than an outer diameter the shaft, and the adjuster plate adjusts the position of the first rotor in a range until an outer circumferential surface of the shaft comes into contact with an inner surface of the hole.

6. The positive displacement machine according to claim 5, further comprising a fixing screw to fix, to the housing, the first motor in which the position of the first rotor have been adjusted by the adjuster plate.

7. The positive displacement machine according to claim 6, wherein the housing includes an attachment part to which the fixing member is attached, the fixing screw includes:

the shaft attached to the attachment part and projecting from the housing; and a head provided at an end portion of the shaft and having an outer diameter larger than an outer diameter of the shaft, and the adjuster plate includes the hole having an inner diameter larger than the outer diameter of the shaft and smaller than the outer diameter of the head.

8. A compressor comprising the positive displacement machine according to claim 1, wherein the piston compresses gas flowing into the pressure chamber.

9. A cooling apparatus comprising:

the compressor according to claim 8, which compresses working fluid in a gas phase; and the cooling apparatus further comprises a condenser to condense the working fluid in the gas phase compressed by the compressor into the working fluid in a liquid phase;

an expander to decompress the working fluid in the liquid phase condensed by the condenser and change the working fluid in the liquid phase to the working fluid in which the liquid phase and the gas phase are mixed; and an evaporator coupled to a cooling target to transfer heat, the evaporator changing the working fluid flowing from the expander to the working fluid in the gas phase with the heat transferred from the cooling target and discharge the changed working fluid in the gas phase to the compressor.

10. Electronic equipment comprising the cooling apparatus according to claim 9.

* * * * *